US009926112B2

(12) United States Patent
Greenberg

(10) Patent No.: US 9,926,112 B2
(45) Date of Patent: Mar. 27, 2018

(54) CONTAINMENT SYSTEM AND ADAPTIVE SEALING SYSTEMS THEREFORE WITH COLLAPSIBLE FEATURE AND METHODS FOR OPERATING THE SAME

(71) Applicant: Daniel Greenberg, Cold Spring, NY (US)

(72) Inventor: Daniel Greenberg, Cold Spring, NY (US)

(73) Assignee: Daniel Greenberg, Cold Spring, NY (US)

( * ) Notice: Subject to any disclaimer, the term of this patent is extended or adjusted under 35 U.S.C. 154(b) by 885 days.

(21) Appl. No.: 14/060,675

(22) Filed: Oct. 23, 2013

(65) Prior Publication Data

US 2015/0108154 A1 Apr. 23, 2015
US 2017/0233151 A9 Aug. 17, 2017

Related U.S. Application Data

(63) Continuation of application No. PCT/US2012/034778, filed on Apr. 24, 2012.

(60) Provisional application No. 61/478,745, filed on Apr. 25, 2011, provisional application No. 61/807,592, filed on Apr. 2, 2013.

(51) Int. Cl.
*B65D 43/22* (2006.01)
*B65D 43/16* (2006.01)
*B65D 43/06* (2006.01)

(52) U.S. Cl.
CPC ..... *B65D 43/22* (2013.01); *B65D 43/06* (2013.01); *B65D 43/16* (2013.01)

(58) Field of Classification Search
CPC ..... B65D 2251/1083; B65D 2251/20; B65D 2255/06; B65D 43/165; B65D 43/22; B65D 43/16; B65D 43/06
USPC ..... 220/826, 780, 782, 795, 324, 326, 831, 220/832, 849, 834, 840, 843, 666
See application file for complete search history.

(56) References Cited

U.S. PATENT DOCUMENTS 3,282,462 A * 11/1966 Box ..... B65D 1/243 206/508
4,364,489 A 12/1982 Alexeeff
5,328,048 A 7/1994 Stein
(Continued)

FOREIGN PATENT DOCUMENTS

JP 2004-307054 11/2004

OTHER PUBLICATIONS

PCT/US2012/034778, Search Report and Written Opinion dated Nov. 26, 2012, 9 pgs.

*Primary Examiner* — J. Gregory Pickett
*Assistant Examiner* — Niki M Eloshway
(74) *Attorney, Agent, or Firm* — Andrew F. Young, Esq.; Lackenbach Siegel, LLP

(57) ABSTRACT

A containment system includes a bounded container having a shaped rim region and a sealing multi-hinged lid system engaging respective rim regions and respective closing lid members. Optionally, the wall sections are collapsible and a rim-lid interface and a lid-lid interface are discontinuous to aid sealing. Optionally, a sliding lock function is provided to enhance positive lid closure. An alternative interfitting arrangement provides a positive compressive urging proximate respective contact regions where the lids and the shaped rim interfit, and between lids, to provide air and moisture resistance to the containment system.

18 Claims, 32 Drawing Sheets

(56) References Cited

U.S. PATENT DOCUMENTS

| | | | | | |
|---|---|---|---|---|---|
| 5,353,948 | A * | 10/1994 | Lanoue | B65D 21/064 | 220/826 |
| 5,967,322 | A * | 10/1999 | Apps | B65D 21/064 | 206/497 |
| 6,315,151 | B1 * | 11/2001 | Hupp | B65D 1/225 | 220/6 |
| 2007/0080160 | A1 * | 4/2007 | Lutzke | B65D 43/166 | 220/326 |
| 2009/0173744 | A1 * | 7/2009 | Hassell | B65D 43/164 | 220/826 |
| 2009/0321462 | A1 * | 12/2009 | Hui | B65D 43/021 | 220/780 |
| 2012/0152944 | A1 * | 6/2012 | Vilkomirski | B25H 3/022 | 220/4.28 |
| 2012/0255965 | A1 * | 10/2012 | King | B65D 43/164 | 220/826 |
| 2012/0279980 | A1 * | 11/2012 | Koefelda | B65D 43/22 | 220/826 |
| 2013/0233874 | A1 * | 9/2013 | Sundnes | B65D 43/16 | 220/826 |

* cited by examiner

300
ELEVATION SIDE W/LID OPEN

ELEVATION END W/LIDS OPEN

AERIAL VIEW LIDS OPEN

EASY POUR SPOUT
ELEVATION END W/LIDS CLOSED 301A
301B
303A
303B
310
320

CONTAINMENT SYSTEM AND ADAPTIVE SEALING SYSTEMS THEREFORE WITH COLLAPSIBLE FEATURE AND METHODS FOR OPERATING THE SAME

CROSS REFERENCE TO RELATED APPLICATIONS

This application refers to, is a continuation application of, and claims priority from PCT Ser. No.: PCT/US2012/034778 filed Apr. 24, 2012, which in turn relates to and claims priority from U.S. Ser. No. 61/478,745 filed Apr. 25, 2011, the entire contents of which are also incorporated herein by reference. This application also refers to and claims priority from U.S. Ser. No. 61/807,592 filed Apr. 2, 2013, the entire contents of which are incorporated herein by reference.

FIGURE SELECTED FOR PUBLICATION

FIG. 49

BACKGROUND OF THE INVENTION

1. Field of the Invention

The present invention generally relates to a containment system and adaptive sealing systems therefore having a base container and alternative configurations are provided. In particular, the invention relates to a containment system having a bounded container with a shaped rim region and a sealing lid system engaging the rim region where closing lid members are optionally hingably engaged for staged or simultaneous closing or optionally unitary closing optionally with gasket engagements and side walls of the container allow compaction for space reduction aspects and other feature as will be disclosed herein.

2. Description of the Related Art

The term "container" meaning "to contain" can be traced to the $17^{th}$ century, but it was not used to describe rigid molded containers until early $20^{th}$ century. Generally, a container or optionally a "tote", made from any suitable material including plastic, glass, metal or otherwise, is a container of some kind that is configured to hold diverse day-to-day objects including, but not limited to books, tools, toys, and other recreational gear. The container may also be used as a supporting volume for transporting food items, beverages and other relatively small items typically piled upon one another in the tote. Additionally it is recognized as desirable to stack multiple open and closed containers between uses for convenient storage. In other words, the container is an everyday carrier for a variety of rather prosaic objects and items.

It is also not uncommon to secure the access to the interior of a container or "tote" in various ways. A myriad of securing mechanisms or 'lids' for containers are disclosed in various publications. Perhaps one of the most well known configurations has been provided by Tupperware® since the 1960's when molded plastic container formation (e.g., injection molding) began. A typical Tupperware® container includes a shaped volume (bottom dish) having an upwardly projecting (away from a base) rigid tongue member having parallel sides extending about an outer rim. A seperable (e.g., fully removable) lid is typically flat and has an outer edge with downwardly projecting (toward a base) a female slot opening with corresponding parallel sides to slidably engage a tongue member.

Such Tupperware® tongue-and-slot arrangements provide a sealing based solely upon the friction resistance between the parallel side walls of the tongue-slot configuration. Thus, the resistance is increased or decreased solely by the height and length of the walls/slots respectively. Greater sealing ability requires awkward geometry.

This conventional configuration has lead to unsatisfactory sealing, and loss of a seal where heavy stacks are arranged causing deformation, or where such flat lids span a distance and leave supporting side walls behind. Additionally, such tongue-slot arrangements result in a non-flat top surface because the arrangement mandates a projecting upper-outer rim for the tongue-slot arrangement. Thus, between the center of such a lid and the upper-outer rim there is a difference in projected height relative to the base, and this makes stacking difficult. Additionally, such lids are removable, not typically hinged and are therefore easily separated from bottom member.

A need therefore exists for an aesthetically appealing but still functional bounded container system with a positive continuous contact based upon a compressive spring urging functionality and not on a length of sliding friction as a securing mechanism.

Another need exists for a container system with hingably secured lid members where the spring urging seal is distant from and not disturbed by a frictional hinge arrangement. Alternative and adaptive gasket-involved sealing arrangements are optionally provide spring urging forces for continuous engagement.

Accordingly, there is a need for an improved containment system including a bounded container having a shaped rim region and a sealing lid system inter-engaging the rim region and respective closing lid members. Closing lid members are needed which are optionally hingably engageable with the bounded container and provide optional staged or simultaneous closing, with sealing corner arrangements to secure to a rim. Adaptive gasketing arrangements allow for non-hinged lid system closing.

Additionally, there is a need for an interfitting arrangement providing a positive compressive urging (force) proximate respective contact regions, both along the length of a lid interface and wherein the respective lids and the shaped rim interfit to provide air and moisture resistance, even under substantial stress as in weight stacking.

Overall, there is a need for an improved sealing container system responsive to alternative adaptations and requirements.

ASPECTS AND SUMMARY OF THE INVENTION

These and other needs are satisfied by a containment system with a securing sealing lid and shaped rim configured in accordance with optional embodiments of the present invention wherein side walls allow compaction for reduction in volume between uses or during a use. One of many salient features of the invention includes closing lid members optionally hinged for staged or simultaneous sealing closing and compressive urging with shaped rim regions of a container in combination with a base geometry that allows compaction. In each embodiment, an interfitting arrangement provides a positive compressive urging (spring force) proximate respective contact regions where the lids and the shaped rim interfit to provide air and moisture resistance.

An alternative aspect of the present invention provides adaptive gasketing arrangements allow for non-hinged lid system closing.

Another alternative aspect of the present invention provides adaptive hinges allowing positive lid positioning throughout a lid swing arc and also enable operative and convenient stacking without lid interference rising above a rim level of a stack.

Another alternative aspect of the present invention provides a snap lock arrangement relative to a flexing extending tab member in addition to an interfitting seal proximate respective lid-container contact regions.

Another alternative aspect of the present invention provides a sliding lock arrangement relative to the continuous edge protuberance whereby a closed and interfit pair of lids receives a sliding lock member securing a lid-portion protuberance to a container-side-wall-portion protuberance to prevent unintentional separation. In these aspects, each protuberance is gripped by the sliding lock in a locked condition and the slide lock slides away from the same to an unlocked condition. Such sliding lock arrangements can exist on one or multiple sides of a container (e.g., four on a four-sided container, or two on a four-sided container, or three on a three-sided container) within the bounds of one of skill in the art adapting the arrangement to the alternative container.

The present invention is a containment system includes a bounded container having a shaped rim region and a sealing lid system engaging respective rim regions and respective closing lid members. Closing lid members are optionally hingably engageable with the bounded container and provide optional staged or simultaneous closing. Optional and adaptive gasketing arrangements allow for non-hinged lid system closing. In an each embodiment, an interfitting arrangement provides a positive compressive urging proximate respective contact regions where the lids and the shaped rim interfit to provide air and moisture resistance to the containment system. Optional adaptive hinges allow positive lid positioning throughout a lid swing arc and also enable operative and convenient stacking.

According to another optional embodiment of the present invention, there is provided a containment system, comprising: a bounded container having a continuous rim, a sealing lid system engaging the continuous rim, and means for positive urging of the sealing lid system to the continuous rim, whereby the means for positive urging enables an operative and continuous secure sealing of the sealing lid system to the bounded container.

According to another optional alternative embodiment of the present invention, there is provided a containment system, wherein: the sealing lid system, further comprises: at least a first lid member and a second lid member, the means for positive urging, further comprising: a lid-sealing between the at least first lid member and the second lid member, whereby the means for positive urging enables the operative and continuous secure sealing to include a continuous inter-lid seal.

According to another optional alternative embodiment of the present invention, there is provided a containment system, further comprising hinge means pivotably operative between the bounded container and at least one of the lid members enabling the at least one of the lid members to transit through a motion arc from a fully sealed position to a fully open position, and the hinge means includes optional detents or friction mechanism for enabling the hinge to retain the at least one of the lid members at a selected position along the motion arc relative to the bounded container (e.g., fully or partially open/closed).

According to another optional alternative embodiment of the present invention, there is provided a containment system, wherein: the means for positive urging of the sealing lid system operative to enable one of a simultaneous closing of the first and the second lid members and a staged closing of the first and the second lid members, whereby the continuous inter-lid sealing is maintained.

According to another optional and alternative embodiment of the present invention, there is provided a containment system, further comprising: at least one channel means spanning at least a portion of the sealing lid system, the channel means including a recessed passage defined as recessed relative to an upper surface plane of the sealing lid system, whereby external materials received on the sealing lid system transit through the recessed passage away from the sealing lid system and the containment system.

According to another optional and alternative aspect of the present invention, there is provided a containment system wherein: the lid-sealing between the first lid member and the second lid member, further comprising: first flex-lid locking means for means for locking the first lid member to the second lid member in the continuous inter-lid seal, the first flex-lid locking means including an extending flex-lid tab member extending from one of the first and second lid members toward the other lid member and being formed of a resilient material, one of a male and a female catch member on the one of the first and second lid members, the other of the male and female catch member on the other of the first and second lid members, and the extending tab member being proximate the one of the male and female catch members, whereby during a use a flexing of the extending tab member disengages the male and female catch members and an urging return flex of the extending tab member re-engages the male and female catch members operative to engage the means for locking the first lid member to the second lid member in the continuous inter-lid seal.

According to another optional and aspect of the present invention, there is provided a containment system, wherein: the means for positive urging of the sealing lid system to the continuous rim, further comprising: first flex-rim locking means for locking the sealing lid system to the continuous rim of the bounded container, the first flex-rim locking means including an extending flex-rim tab member extending from the sealing lid system proximate the continuous rim and formed from a resilient material, one of a male and a female catch member on the one of the first flex-rim tab member and the continuous rim, the other of the male and female catch member on the other of the flex-rim tab member and the continuous rim, and the flex-rim extending tab member being proximate the one of the male and female catch members, whereby during a use a flexing of the flex-rim extending tab member disengages the male and female catch members and an urging return flex of the flex-rim extending tab member re-engages the male and female catch members operative to engage the first flex-rim locking means for locking the sealing lid system to the continuous rim in the continuous seal.

Further Description of Optional Features of the Inventive Systems

A containment system with a bounded container includes a sealing lid system having simultaneous closing lid members wherein the lids and a rim of the container are formed for operative secure respective interfitting providing air and moisture resistance through positive compressive urging proximate respective contact regions.

A containment system with a bounded container includes a sealing lid system having closing lid members wherein the lids are formed for operative secure respective interfitting with each other to provide air and moisture resistance therebetween through positive compressive during proximate respective contact regions.

Another alternative containment system includes a pressure-seal release feature allowing a sealed or in-process-sealing-container to expel a portion of contained gas (e.g., burping), wherein the pressure seal may include a one-way valve, a hinged-valve cover opening (on a portion of the containment system), a plug-and-hole feature allowing removal for release of gas and re-sealing thereafter.

A containment system with a bounded container includes a sealing lid system having staged closing lid members wherein the lids and a rim of the container are formed for operative securing interfitting in a step-wise sealing manner to provide an air and moisture resistance through positive compressive urging proximate respective contact regions.

A containment system with a bounded container includes a unitary central lid member spanning a portion of the container and provided with opposing sealing lids hingably joined thereto, wherein the lids, a rim of the container, and the unitary central lid member are formed for operative secure interfitting providing air and moisture resistance through positive compressive urging proximate respective contact regions.

A containment system for a bounded container includes a hinged sealing lid system with a plurality of hinged lid members each arranged with a gasket interfit region proximate the bounded container and the respective lid members providing an operative air and moisture resistance through positive compressive urging proximate respective contact regions.

A containment system with a bounded container includes a sealing lid system providing a positive continuous contact with a rim of said bounded container whereby a positive and continuous urging contact is maintained while the sealing lid system is closed.

A containment system with a bounded container includes a sealing lid system containing a gasket interfit region with the bounded container providing air and moisture resistance through positive compressive urging proximate respective contact regions.

A containment system with a bounded container includes a hinged sealing lid system wherein the respective hinge elements provide an operative pivot resistance to respective lids of said sealing lid system, whereby a lid position may be maintained at any time through a swing arc relative to the bounded container through the pivot resistance.

A containment system with a bounded container includes a hinged sealing lid system providing a formation of sealing lids and a rim of the container for operative secure interfitting providing air and moisture resistance through positive compressive urging proximate respective contact regions into continuous contact, whereby the hinged function elements are independent of the sealing function elements of the lid system thereby allowing easy adaptation to alternative hinge constructions.

A containment kit system includes a bounded container member and a sealing lid system, whereby the sealing lid system and a rim of the bounded container member are shaped to provide compressive continuous urging together following engagement resulting in an air and moisture resistance relative to the entire bounded container member while additionally the sealing lid system may be separated from the bounded container member and engaged with a different appropriately shaped bounded container member.

A containment system with a bounded container and at least one pivotally connected hinged sealing lid system providing a formation of an air and moisture resistance through positive compressive urging proximate respective contact regions, whereby a plurality of the containment systems can be co-stacked in a lid-open condition in a compact assembly.

A containment system with a bounded container and at least one pivotally connected hinged sealing lid system providing a formation of an air and moisture resistance through positive compressive urging proximate respective contact regions, whereby a drainage channel is formed along a portion of the lid system and is operably effective to drain a fluid received proximate an inner position of the lid system off an outer position of the lid system and away from the bounded container and the contact regions.

A containment system for a non-container closure involving a sealing interface between a first closing member and a closure receiver member along respective sealing contact interfaces. First closing member and closure receiver members are to be understood as a representative of a wide and non-limited variety of consumer items including fluid containers (e.g., coffee mugs, water bottles), product containers (e.g., food jars and cans or cosmetic cases), window or door interfaces for consumer products (e.g., refrigerator, freezer, dishwasher, clothing washer doors etc.) or interfaces for homes, buildings, vehicles, planes, boats etc. (where the building, home, vehicle etc. is the container and doors and windows are the lids). In this manner, one of skill in the art, having studied the entire disclosure will recognize that the disclosure may be adapted to different settings without departing from the scope and spirit of the present invention.

A containment system with a bounded container and at least one pivotally connected hinged sealing lid system providing a separately shaped storage member removably-securable within or hingably mounted with to the bounded container for storing use articles (e.g., utensils). Such a separately shaped storage member may be additionally secured to the lid member(s) or the container, and may be removable or fixed thereto. In this way the proposed invention includes a larger system including the bounded container sealing lid system and the storage member. The storage member may be a tray, series of holders or trays, separate pocket, or any other type of bounded container or securing member for storing user articles associated with the containment system. For example, a lunch-tote may include a utensil container or food container therewithin, secured to a lid, secured to an interior or exterior surface, or merely contained removably therewithin.

The above and other aspects, features and advantages of the present invention will become apparent from the following description read in conjunction with the accompanying drawings, in which like reference numerals designate the same elements.

BRIEF DESCRIPTION OF THE DRAWINGS

The invention may be better understood by reference to the detailed description of specific embodiments presented herein in combination with the following drawings, in which:

FIG. 50A is a top open view noting an easy pour feature adapted to the containment system and sealing lid system variations discussed herein.

FIG. 50B is a side elevation view of FIG. 50A with one lid open noting the extended position of pouring lips.

FIG. 50C is a left side elevation view of FIG. 50B with both lids closed.

FIG. 50D is a right side elevation view of FIG. 50B with both lids opens.

DETAILED DESCRIPTION OF THE PREFERRED EMBODIMENTS

Figure 1:
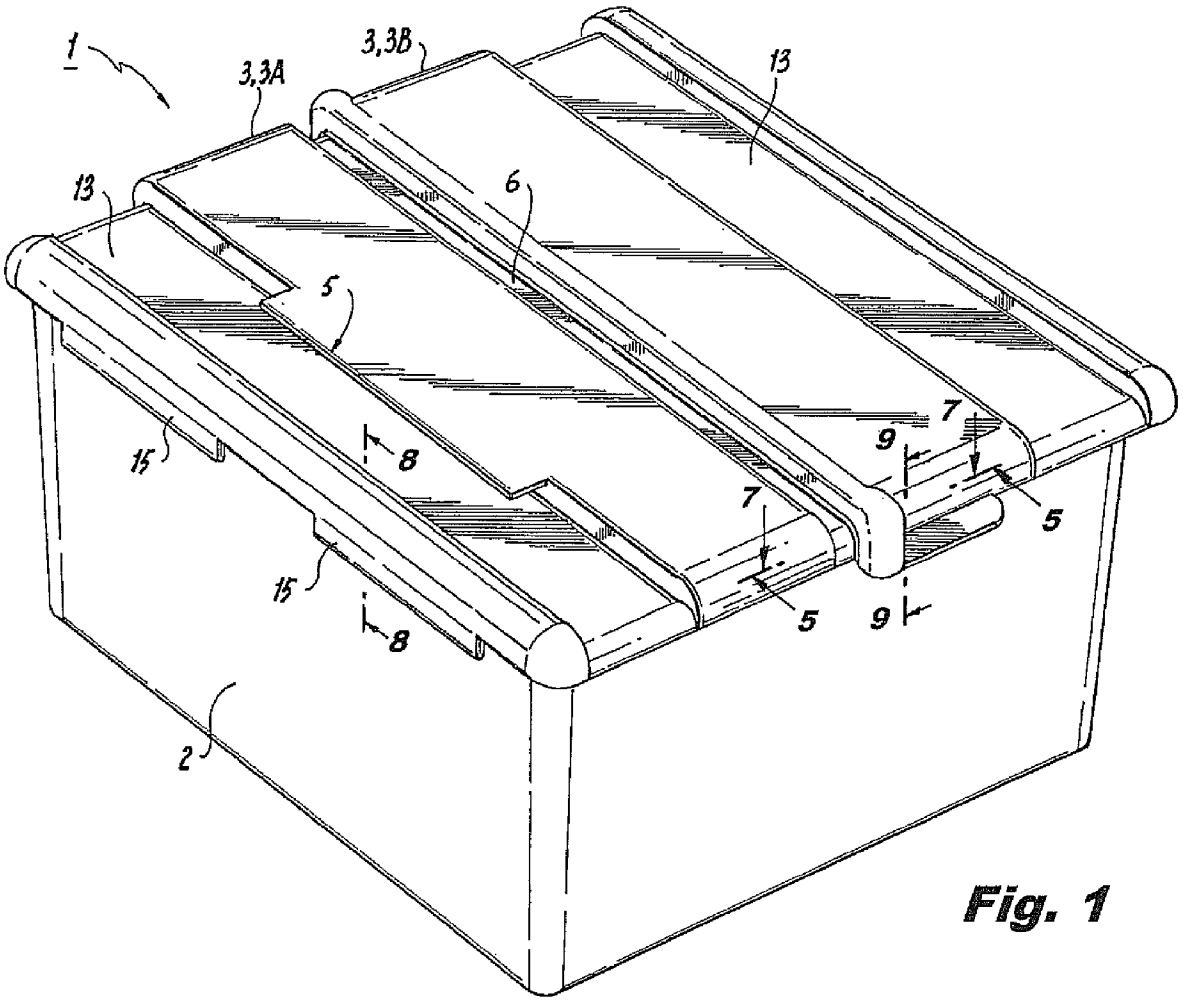
FIG. 1 is a perspective view of a first embodiment of the present invention showing a staged or stepped lid opening.

Reference will now be made in detail to several embodiments of the invention that are illustrated in the accompanying drawings which are not to precise scale. Wherever possible, same or similar reference numerals are used in the drawings and the description to refer to the same or like parts or steps. The drawings are in simplified form, here representing exemplary photographed systems or kits, and are not to precise scale. For purposes of convenience and clarity only, directional terms, such as top, bottom, up, down, over, above, below, or near etc. may be used with respect to the drawings. These and similar directional or distant terms should not be construed to limit the scope of the invention in any manner. The words "connect," "couple," and similar terms with their inflectional morphemes do not necessarily denote direct and immediate connections, but also include connections through mediate elements or devices. It will be further recognized that elements discussed in the context of one alternative embodiment, may be adaptively and alternatively combined with ones of other alternative embodiments without departing from the scope or spirit of the present invention.

The present invention is a containment system and includes a bounded container having a shaped rim region and a sealing lid system engaging respective rim regions and respective closing lid members. Closing lid members are optionally hingably engageable with the bounded container and provide optional staged or simultaneous or gasketed closing. In each embodiment, an interfitting arrangement provides a positive compressive urging proximate respective continuous contact regions where the lids and the shaped rim interfit to provide air and moisture resistance to the containment system. Optional adaptive hinges allow positive lid positioning throughout a lid swing arc and also enable operative and convenient stacking.

Referring now to FIG. 1 a first alternative embodiment of a staged sealing containment system 1 including a container 2 having a lid system 3 shown as a bottom lid 3A and a top lid 3B. Respective lids 3A, 3B are shaped in a continuous profile about an outer periphery and along an inter-lid-interface as will be discussed. A locking snap handle extension 4 projects from top lid 3B in this embodiment. A lid lifting handle 5, is noted on bottom lid 3A but is to be understood by those of skill in the art as alternatively placeable at any portion along lids 3A, 3B. A channel profile 6 is provided on bottom lid 3A in a manner as will be discussed. It will be recognized that containment system 1 may take any alternative embodiment in keeping with the spirit and scope of the present invention. Alternative live hinges 15 are presented on either lid side.

Figure 2:
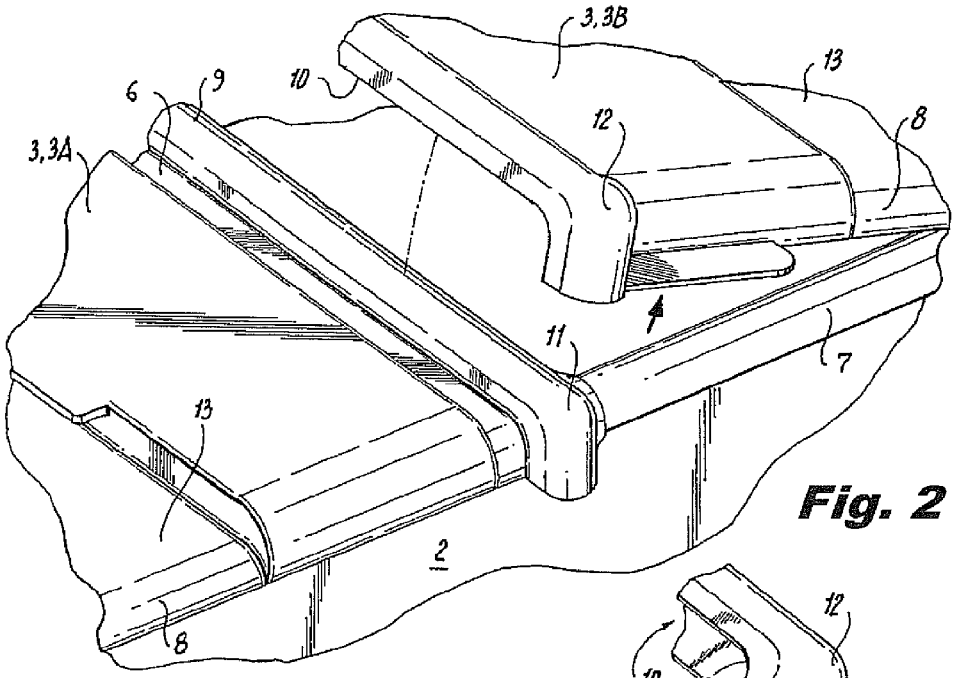
FIG. 2 is a partial operative perspective view of FIG. 1 in a partial open position.
Figure 3:
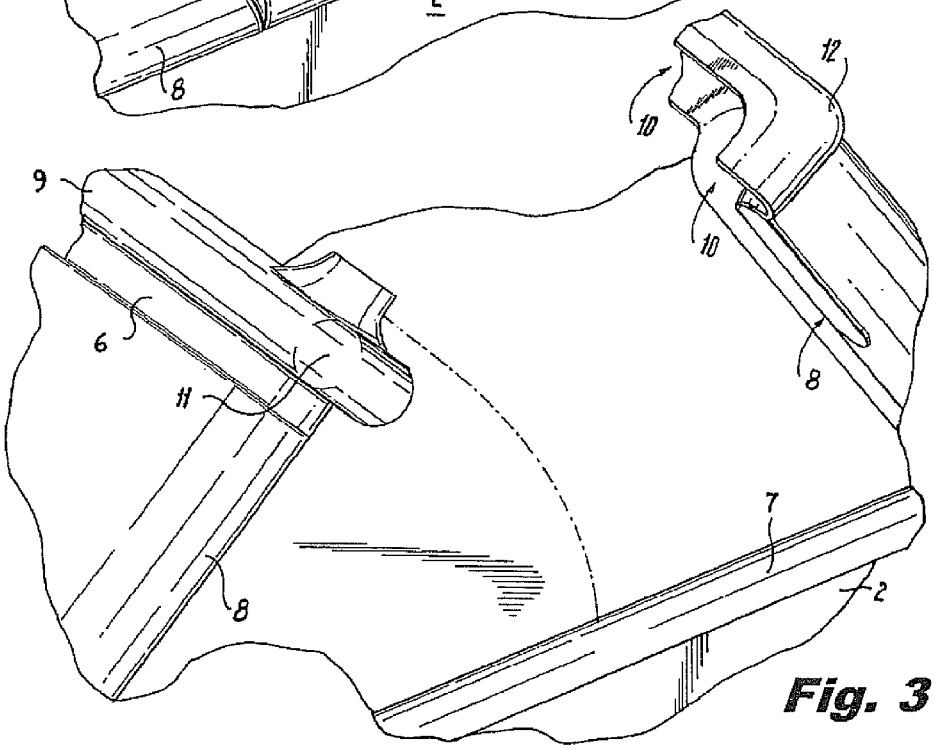
FIG. 3 is a partial operative perspective view of FIG. 2, in a partial open position.

Referring now to FIGS. 2 and 3, containment system 1 is shown with a partial opening of lids 3A, 3B wherein bottom lid 3A is in a closed position (FIG. 2) or in a partially open position (FIG. 3). As will be understood, this embodiment illustrates a step-wise or sequenced closing. Container 2 includes a rolled upper continuous wall or rim 7 forming a male or positive surface, as illustrated. Each lid 3A, 3B includes about a side portion a respective continuous female or negative surface profile 8 that has a complementary profile as rim 7, such that in a closed position there is a connective urging interfit. Here, the profiles are semi-circular/partially circular such that the receiving female profile is slightly tighter than the male profile thereby providing a tension during interfit. Because rim 7 and profile 8 are continuous about an outer rim region the outer seal is continuous in a closed position.

Bottom lid 3A is formed with a male profile projection 9 which similarly extends or spans along the entire lid-lid interface distance to each rim-side. On top lid 3B is a complementary female receiving or negative surface profile 10 shaped to operably receive projection profile 9 for a continuous interfit. As will be also understood complementary bottom edge profile 11 and top edge profile 12 are noted on respective lids so that at the interface between each lid edge the profiles both squeeze onto each other, but also aid in squeezing rim profile 7, to effectuate an operative continuous urging at each interface. Recess regions 12, 12 on either lid 3A, 3B are provided as additional drains (as with channel 6) or as convenient construction features.

Figure 4:
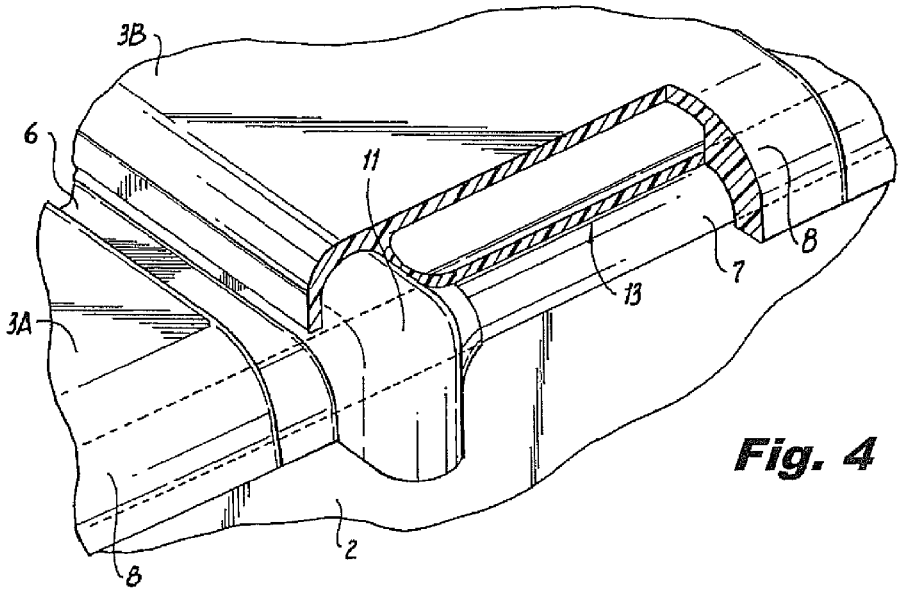
FIG. 4 is a partially cut-away view of FIG. 1 noting lid-container sealing urging along contact regions of lid and container.
Figure 5:
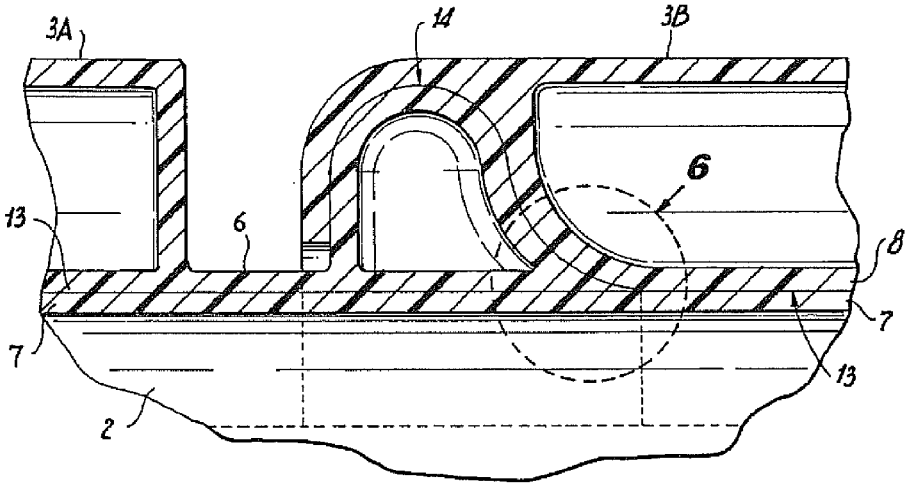
FIG. 5 is a partial sectional view along Section 5-5 in FIG. 1, noting a continuous seal.

Referring now to FIGS. 4 and 5 a partial cross-sectional view and sectional view are presented along the lid-lid and rim interface. As will be noted, a continuous interfit contact between rim 7 and profiles 8, noted at 13 extends continuously along the rim-lid interface. Similarly, a continuous lid-lid interfit contact between lids 3A, 3B, noted at 14 extends along the interface.

Figure 6:
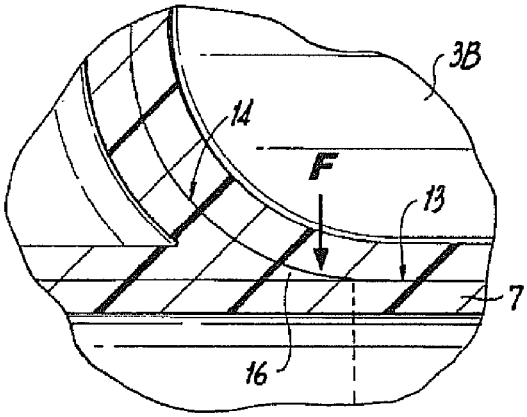
FIG. 6 is a partial close-up view of FIG. 5 noting a flexible sealing lip for continuous sealing force (F).

Referring now to FIG. 6, it will be recognized by those of skill in the art of plastics forming at continues formation may occur with differing densities and modulus of flex in a unitary formation. Thus, as indicated by F a downward force is presented by closing lids 3B on rim 7 forming continuous seal 13 and 14. Edge lip member 16 is to be understood as compressed during a sequenced closing of lids 3A, 3B for a continuous seal.

Figure 7:
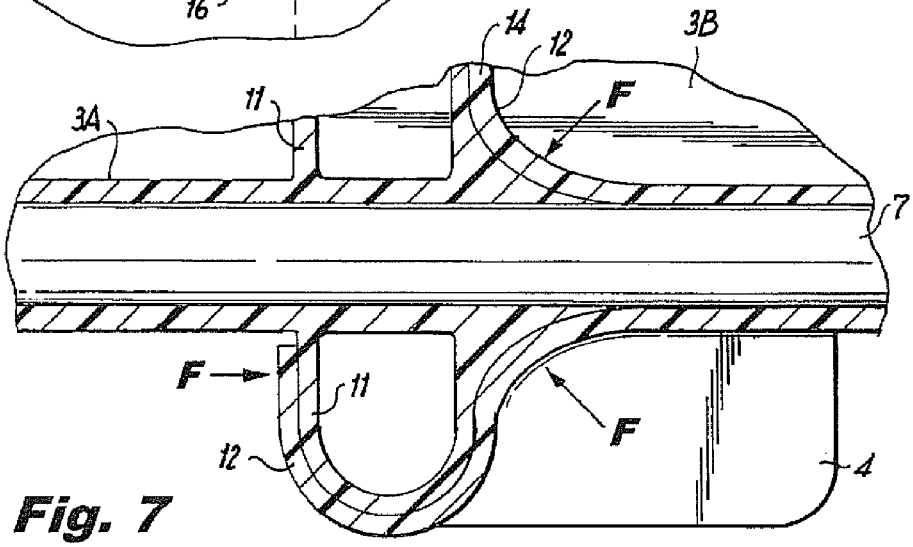
FIG. 7 is a partial cut away relieved lid section view along Section 7-7 in FIG. 1 noting the continuous urging sealing forces F along entire projecting male member for a complete continuous contact.

Referring now to FIG. 7 a sectional view along Section 7-7 in FIG. 1, as will be understood, similar compressive sealing forces F, F, and F are illustrated continuously along the male-female interfit seal between rim 7 and between respective projection forms 11 and 12, such that as member 12 curves continuously around respective lid 3A and over rim profile 7, there is a continuous compressive urging force.

Figure 8:
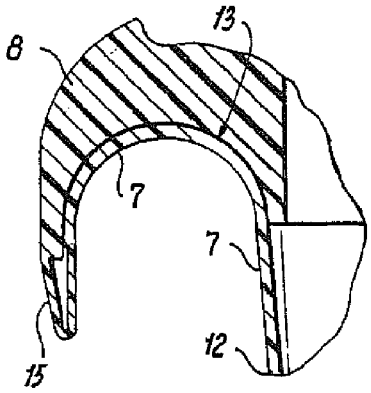
FIG. 8 is an illustrative partial sectional view along Section 8-8 in FIG. 1, illustrating an alternative hinge design and sealing arrangement.

Referring additionally now to FIG. 8 a partial view of hinge 15 is presented, noting a live formation via a continuous extension of rim 7 from container 2. As can be seen, in this embodiment, continuous seal 13 is made along substantially the width of rim 7 and similarly also about the perimeter of container 2 by receiving profile 8.

Figure 9:
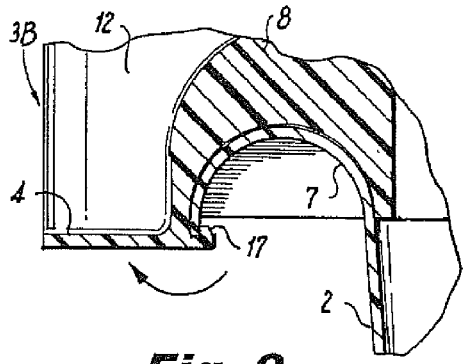
FIG. 9 is an illustrative alternative partial sectional view along Section 9-9 in FIG. 1, illustrating a locking tab engagement.

Referring now to FIG. 9, a partial sectional view is shown from FIG. 1 regarding handle member 4 and overlapping interlocks as shown. In this embodiment handle 4 projects outwardly away from container 2 from lid 3B (See FIG. 1), and includes a projecting clip lock member 17 which engages a terminal edge of rim 7, as shown. To release, a user tensions (lifts) handle member 4, releases clip lock member 17 and removes top lid 3B.

Figure 10:
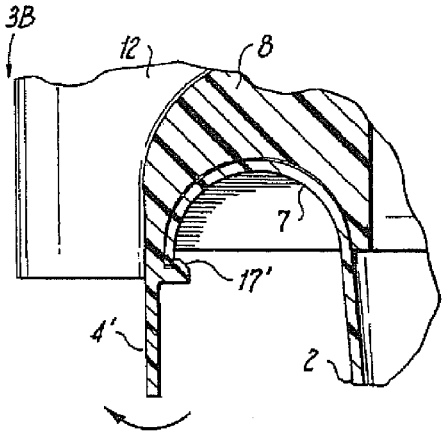
FIG. 10 is an alternative partial sectional view similarly position to FIG. 9, wherein a locking tab projects downwardly for user-gripping-ease.

Referring now to FIG. 10, an alternative partial sectional view, similar to FIG. 9 is provided noting an optional and alternative construction. Here handle 4' projects downwardly away from lid 3B and an alternative clip lock 17' is provided similarly engaging rim 7, as shown. During use, a user tensions handle member 4', releases clip lock member 17' and removes top lid 3B.

Figure 11:
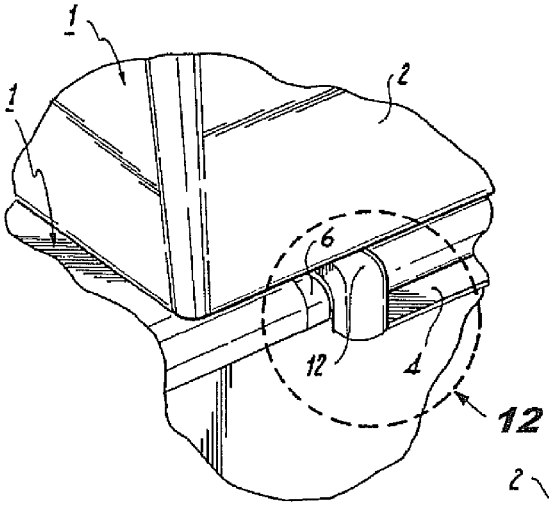
FIG. 11 is an illustrative perspective close-up view of a stacked system noting the availability of a flat stacking plane along a lid system surface for easy and secure stacking.
Figure 12:
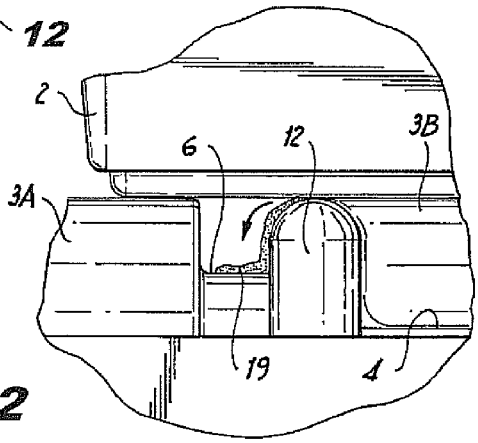
FIG. 12 is a close-up view of region 12 in FIG. 11, providing an illustrative use of the exposed drainage channel extending along the lid system eliminating standing moisture following a leak and the non-interfering lid arrangement with stacked containers.

Referring now to FIGS. 11 and 12 two containment systems 1 are shown in a stacked position. As is indicated the assembly of lids 3A, 3B provides a lid 3 having an flat top plane (with depressions or channel 6, etc.) for receiving a flat bottom surface of a respective containment system and aiding draining. As illustrated, any fluid leak from a top containment system is received as fluid 19 in channel 6, which then traverses channel 6 to an exterior surface and the rounded terminal end of channel 6 for finally transferring onto a floor. In this manner, the present invention provides an important improvement where spilled materials are receive and immediately transferred away from a respective lid. As a result, there is no risk of further penetration of the material, nor is there permitted any build up which may spoil (foods), or cause damage (caustic or acidic).

Figure 13:
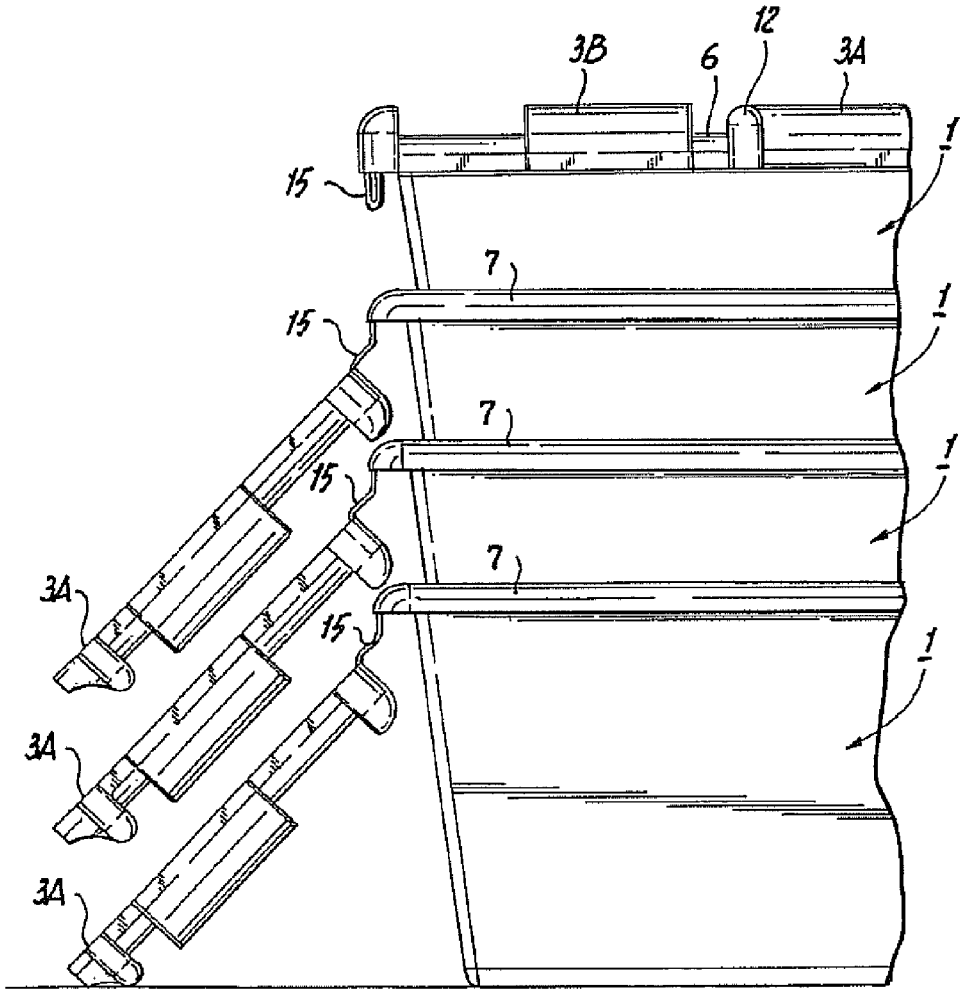
FIG. 13 is an illustrative exemplary view of a stacked system of multiple containers with open lid systems, illustrating how the proposed system permits inter-stacking without retained lid-construction interference.

Referring now to FIG. 13, a series of nesting containment systems 1 are depicted with open lids. As will be recognized, the current invention enables convenient and speedy stacking between uses at a minimum dimension.

Figure 14A:
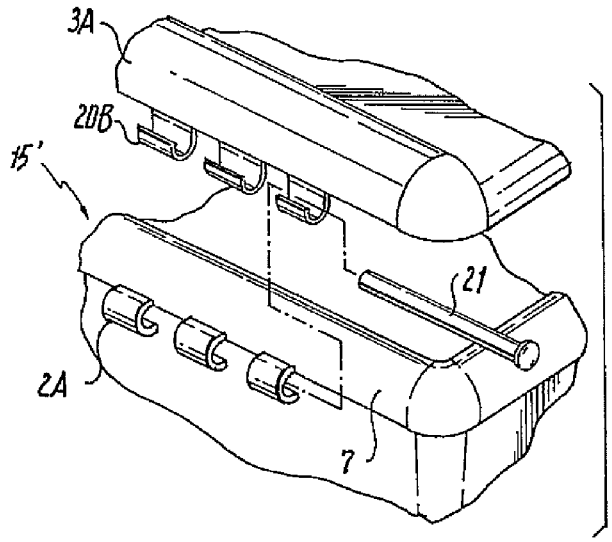
FIG. 14A is one example of an alternative hinge construction adaptive to the present inventions.
Figure 14B:
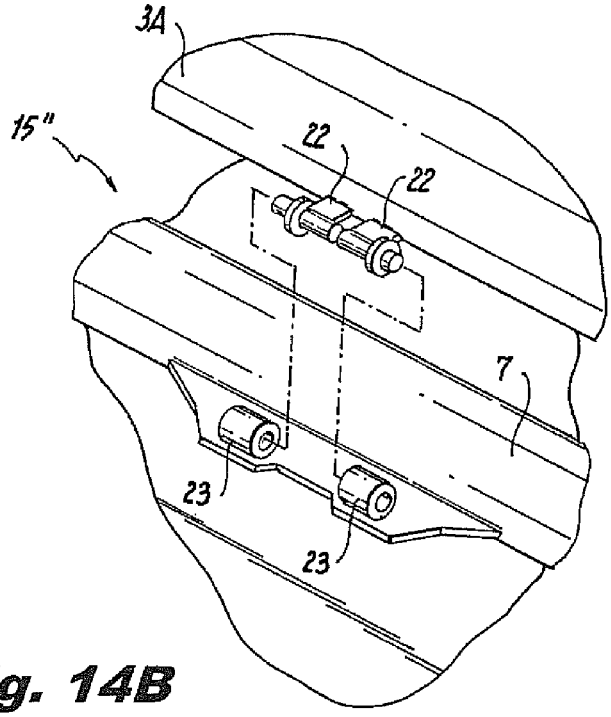
FIG. 14B is another example of an alternative hinge construction adaptive to the present invention.

Referring now to FIGS. 14A and 14B, alternative hinge constructions are permitted according to the present invention and without departing there from. In FIG. 14A, a hinge assembly 15' is provided in two complementary arc-shaped spaced portions 20A, 20B which receive a hinged interference fit from an inserted sliding pin 21, as shown. Portions 20A, 20B and pin 21 are sized so as to provide a mutual compression between lid top 7 and receiving channel in bottom lid member 3A (and respective lid member 3B (not shown)). In FIG. 14B, a hinge assembly 15" is shown with complementary paired male members 22, 22 that pivotably interfit with female pivot members 23, 23 projecting from side rim 7.

As will be understood by those of skill in the art involving hinge members 15, 15' and 15", spaces and locations are arranged to provide a adequate friction tolerance or may include formed detent mechanisms through any arc-swing such that respective lids 3A, 3A may be positioned and retained in a user-desired position by hinge tension/friction (e.g., held open or held partially closed). Upon further use, a user may similarly reposition lids 3A, 3B without departing from the invention. In this way, one lid may be retained, for example, in an up-right position, while the other lid is retained at an acute or obtuse angle relative to rim 7 to aid use.

Figure 15:
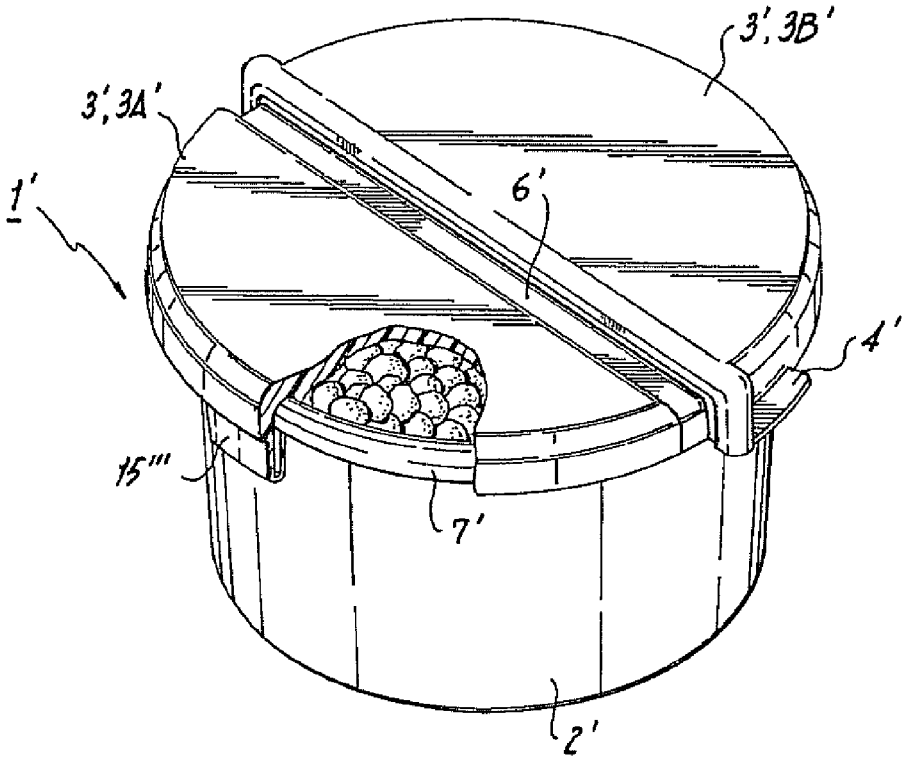
FIG. 15 is an illustrative adaptation of the first embodiment to a rounded container.

Referring now to FIG. 15, an alternative embodiment of the present invention is provided as containment system 1' in rounded form. A container 2' having a continuous rounded upper rim 7' hingably connected via a live hinge 15'" to a rounded bottom lid 3A' and top lid 3B'. Live hinge 15'" is an integrally molded flexible member between container 2' and lid 3'. Rounded top lid 3B" having a handle 4' and bottom lid 3A" having a channel 6', as shown. In this manner, those of skill in the art will recognize that alternative and adaptive containment system geometries are fully enabled by the present invention without departing from the scope and spirit thereof.

Figure 16:
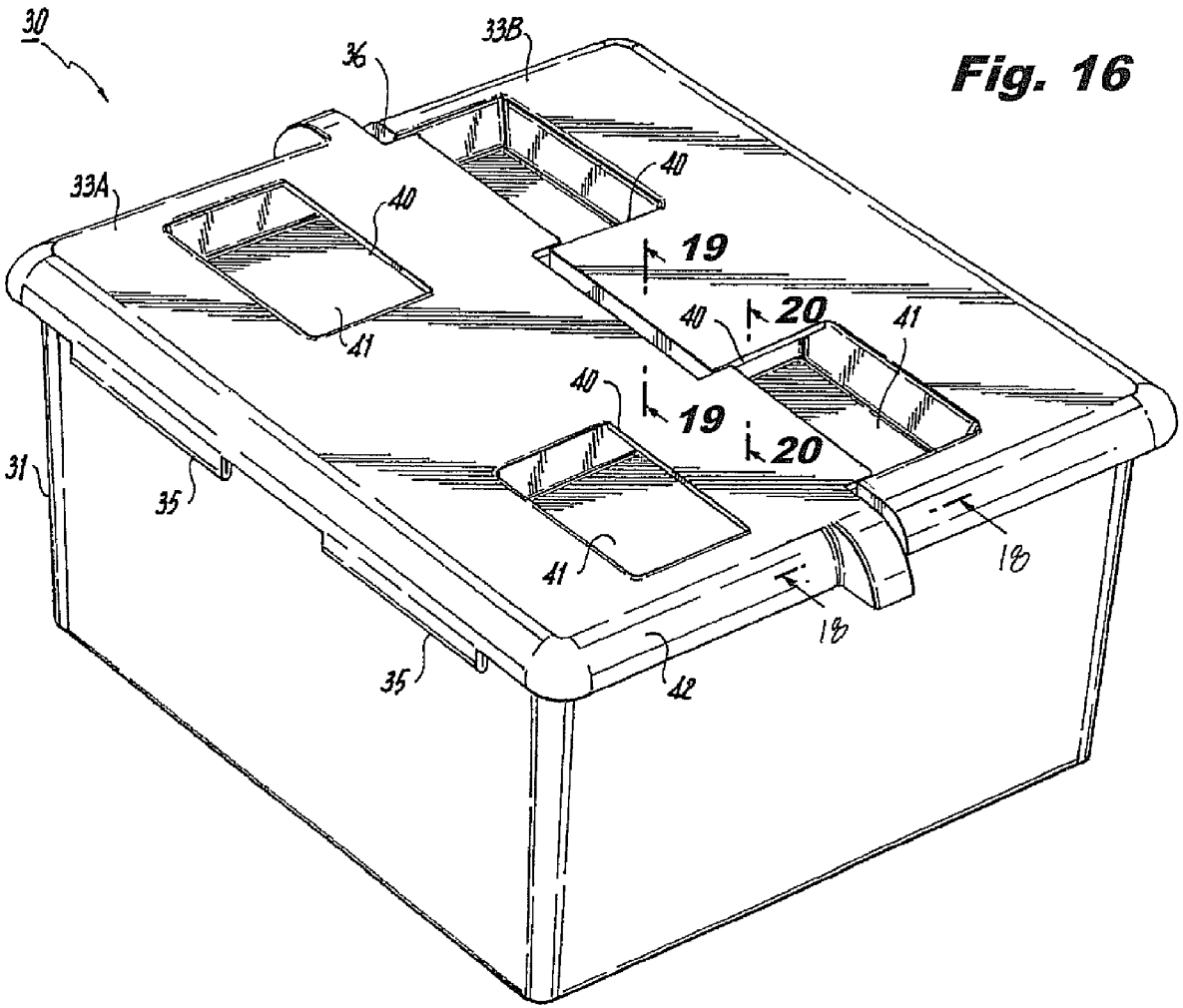
FIG. 16 is a perspective view of a second alternative embodiment of the present invention enabling a simultaneous or continuous opening process.
Figure 17:
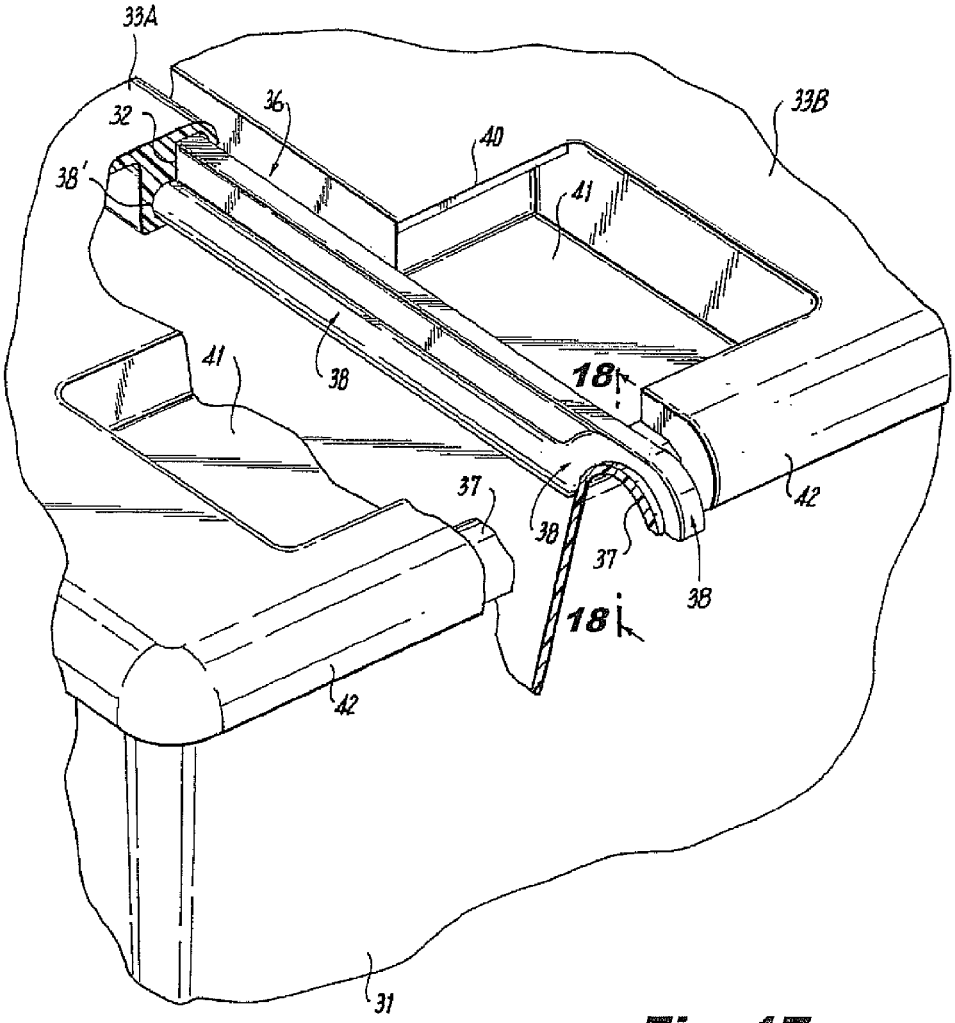
FIG. 17 is a partial cut-away sectional view of FIG. 16 illustrating the continuous male-female interfit and engagement with rolled edge of the container lip and smoothly rounded male member end feature to provide a continuous urging or spring tension for sealing. It is noted that this construction further allows tension along the lid-lid seal from side to side of the container.

Referring now to FIGS. 16 and 17, an alternative inventive containment system 30 is provided enabling simultaneous closing of respective lid members to cover male/female interlock extensions, as will be discussed. It will be further understood, that the projecting locking members can be concealed within an extending lid profile, thereby providing a smooth continuous outer appearance.

A container 31 contains a lid 33 split into a lid member 33A and a lid member 33B (not top and bottom as this construction allows what is effectively termed joint or simultaneous closing, despite the interfit construction noted in the succeeding figures. Container 31 includes an upper continuous rim 37 having a rounded profile similar to that earlier discussed. Alternative and operable hinge assemblies 35, 35 are provided, as shown. Lid member 33B is provided with an operative channel portion 36, as shown in FIGS. 16 and 17. Lifting regions 40 with complementary recesses 41 are provided on each lid 33A, 33B, as shown for user convenience.

A continuous interfit seam shown at 34 engages continuous rim member 37 with respective receiving recesses or female portions 42, 42 of respective lids 33A, 33B creating interfit seam 34. As with the earlier embodiment, those of skill in the art will recognize that the elements can be effectively dimensioned to provide a snap-sealing fit type of enclosure resistant to unintended opening (all embodiments). As will be similarly understood, the interfit between lids 33A, 33B is similarly a continuous seam 32.

As will be appreciated directly from FIG. 17, continuous seam 32 involves an engagement of a continuous rounded projection 38 that extends along the entire length of the lid-lid interface of lid 33B (e.g., up and over rim 37 and curving downwardly to engage the full surface of rim 37 to sustain a continuous seal 34). Respective continuous female channel 38' is presented on lid 33A for continuous snap engagement with continuous projection 38, as shown. It will be similarly understood that channel 38' is similarly extending over rim 37 for continuous sealing.

Figure 17A:
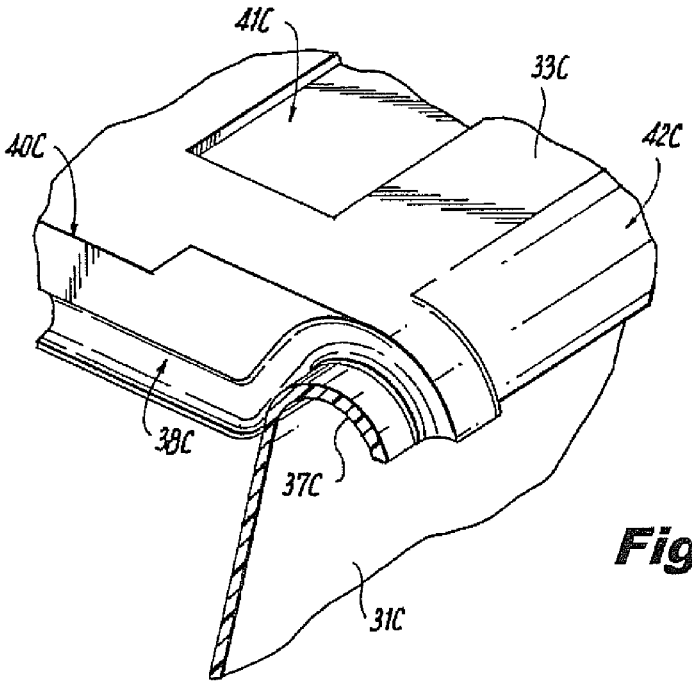
FIG. 17A is a partial cut-away illustrative perspective view related to an alternative continuous male-female interfit along a concave edge, shown in a one-lid open position and one-lid closed.
Figure 17B:
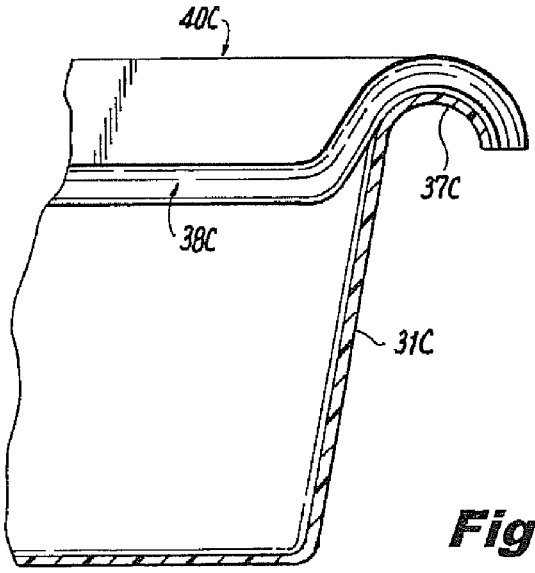
FIG. 17B is a partial sectional elevation view of FIG. 17A, noting the boxed in end of the lid concave edge to receive the rolled male edge. In this manner, a male-female or optionally a male-female lid interfit can be established.

Referring now in the alternative to FIGS. 17A and 17B, where partial cut-away illustrative perspective or elevation views are presented establishing a boxed in-type of end of the lid concave edge to receive the rolled male edge. In this manner, a male-female or optionally a male-female lid interfit can be established without departing from the scope and spirit of the present invention. As shown a base 31C is shown with a first lid 33C in a closed position about a rolled base lip 37C. A continuous female section 38C is presented spanning the width of base 31C and rounding over fully rolled base lip 37C. Gripping lips 40C are similar to those previous, and optional recesses 41C are established for user convenience. As will be understood, the continuous concave female arc profile 38C rounds fully to rolled base lip ends 37C, and extends beyond for full urging gripping of opposing sides of base 31C. Necessarily, the final terminal end 38C' of female section 38C, is shaped to receive the ending of the female concave profile 38C, while also gripping end 37C fully, and should be considered fully-closed or fully retained, although the final terminal geometry may take any forms suitable to the achieving the goals of the present invention. In this way, one of skill in the art will recognize that the current simultaneous closing interface geometry may both reverse male-female/female-male profiles and select other urging tension-sealing geometries that are within the scope and spirit of the present invention.

Figure 18:
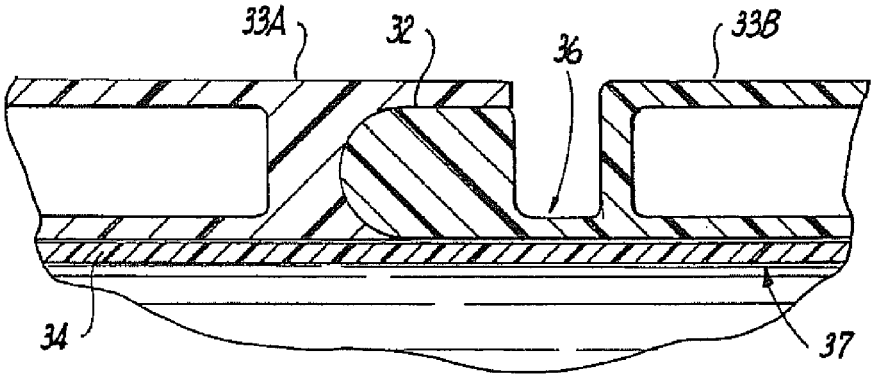
FIG. 18 is a partial sectional view along Section 18-18 in FIG. 16, again noted as a directional view 18-18 in FIG. 17 noting the drainage channel and the continuous interfit for sealing.

Referring now to FIG. 18, the interfit along Section 18, 18 in FIGS. 16 and 17 is shown, noting the continuous seal 32 and 37 both between lids 33A, 33B but also between respective lids 33A, 33B and profile 37. Again, it will be recognized that the precise geometry may not be scale, or may be modified within the teachings of the current invention to achieve the urging sealing required.

Figure 19:
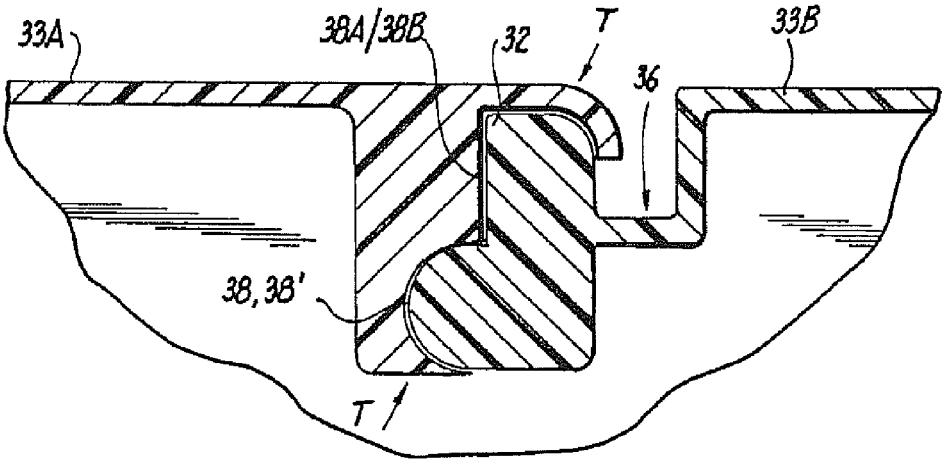
FIG. 19 is an alternative lid interfit construction along Section 19-19 in FIG. 16, noting dual male and dual female interconnection with a drainage channel, thereby providing dual urging sealing noted at opposing tension directions T, T.

Referring now to FIG. 19, as will be understood from the sectional view, a continuous seam 32 is presented between the lids along an urged compression between tension forces at T-T operative to urge the interfit seal together. Similarly, as will be understood, male/female profiles 38, 38' extend continuously, as do a second set of male/female profiles 38A/38B as shown in FIG. 19. In this manner, lids 33A, 33B are joined by dual male/female interfit connections.

Figure 20:
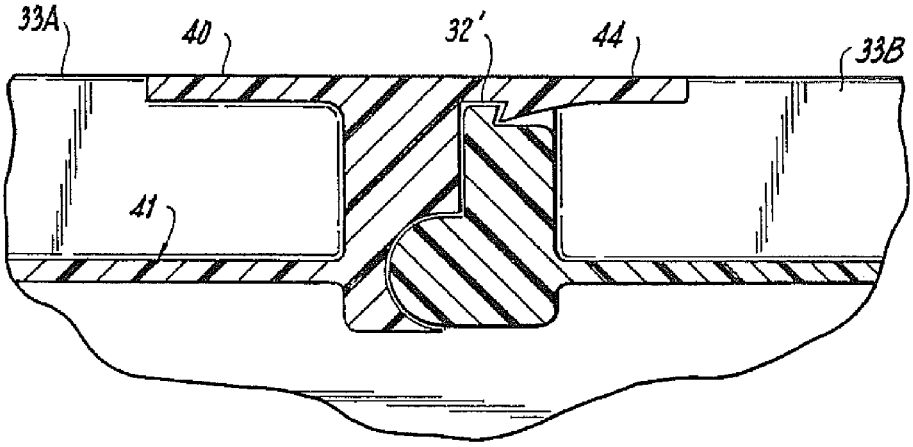
FIG. 20 is an alternative lid interfit constructions along Section 20-20 in FIG. 16 where an extending tab member and a snap-lock type interfit construction provide additional locking security.
Figure 21:
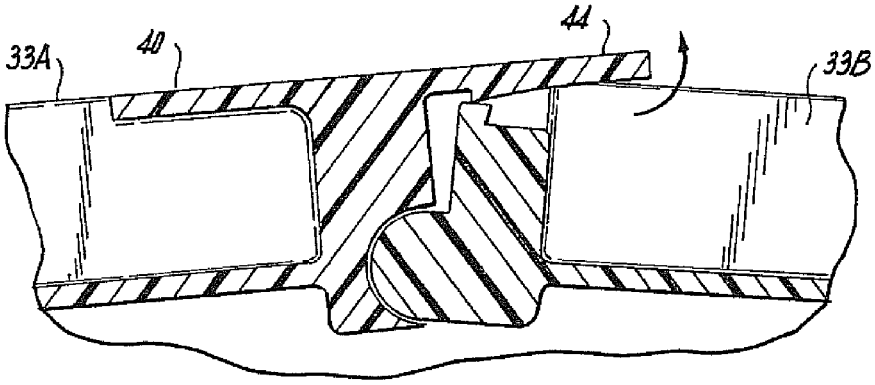
FIG. 21 is an in-use version of FIG. 20 where the extending tab member is bent upwardly disengaging the positive snap-lock type interfit.
Figure 22:
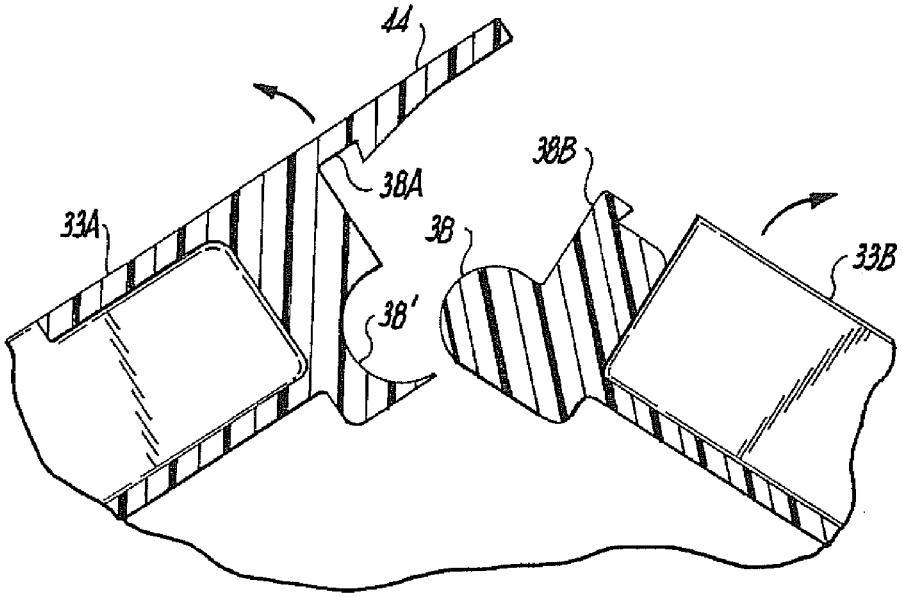
FIG. 22 is a further in-use version of FIG. 21 noting separation of lid members and illustrating the simultaneous or continuous lid opening/closing embodiment introduced in FIG. 16.

Referring now specifically to FIGS. 20-22, where an extending flex tab member 44 is shown projecting from lid 33A over a portion of lid 33B, and respective male/female engagements 38A/38B are now profiled as a snap-lock engagement (shown). As indicated in FIG. 21, during use flex tab member 44 is lifted disengaging the snap-lock engagement. This arrangement provides a further operative interfit lock effective to seal lids 33A, 33B together and to container 31, within the scope and spirit of the present invention.

Referring now to FIGS. 23 through 29 where a gasket-type continuous seal is presented in alternative embodiments and constructions.

Figure 23:
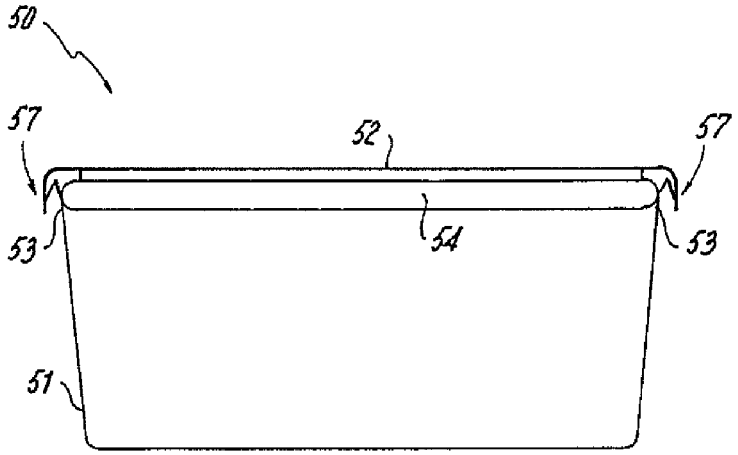
FIG. 23 is an alternative embodiment of the present invention provided as a gasketed based sealing embodiment while retaining the inventive continuous seal and engagement. This version illustrates locking side tabs and a continuous gasket about an inner perimeter of a continuous top lid.
Figure 24:
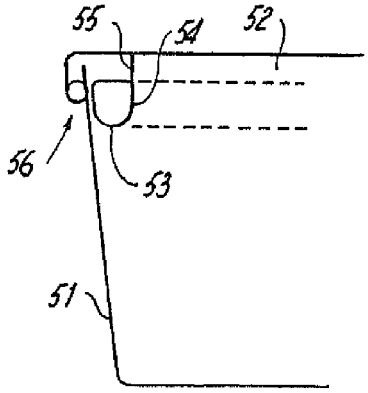
FIG. 24 is an alternative close-up partial sectional illustrative view of an alternative gasket view having a hinge construction separate from the sealing profile.
Figure 25:
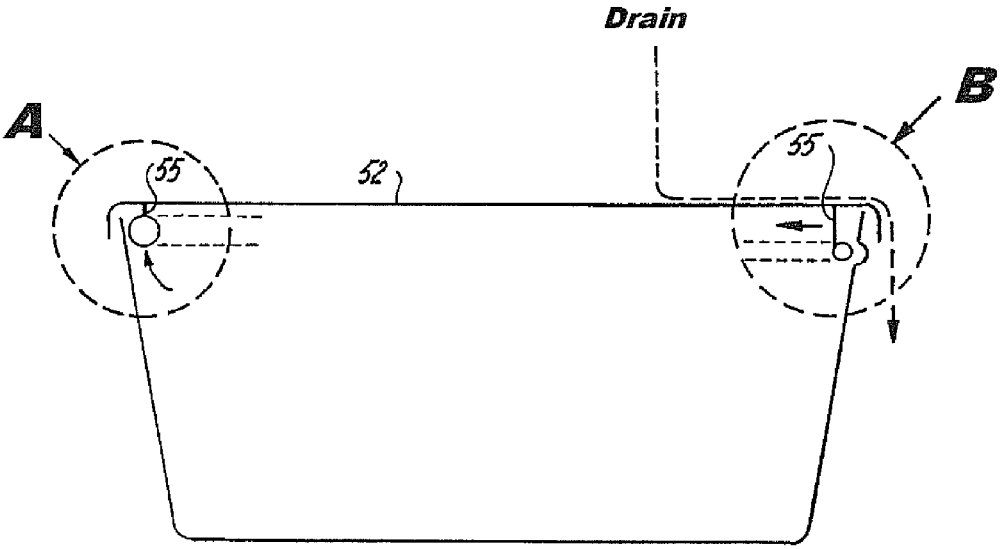
FIG. 25 is an in-use illustration of a continuous top lid with an inner continuous gasket noting side drainage. Section A illustrates a continuous gasket sealing with a smooth inner wall. Section B illustrates an alternative continuous gasket version where a side-wall profile is created to complement a gasket profile, thereby improving an urging sealing connection.
Figure 26:
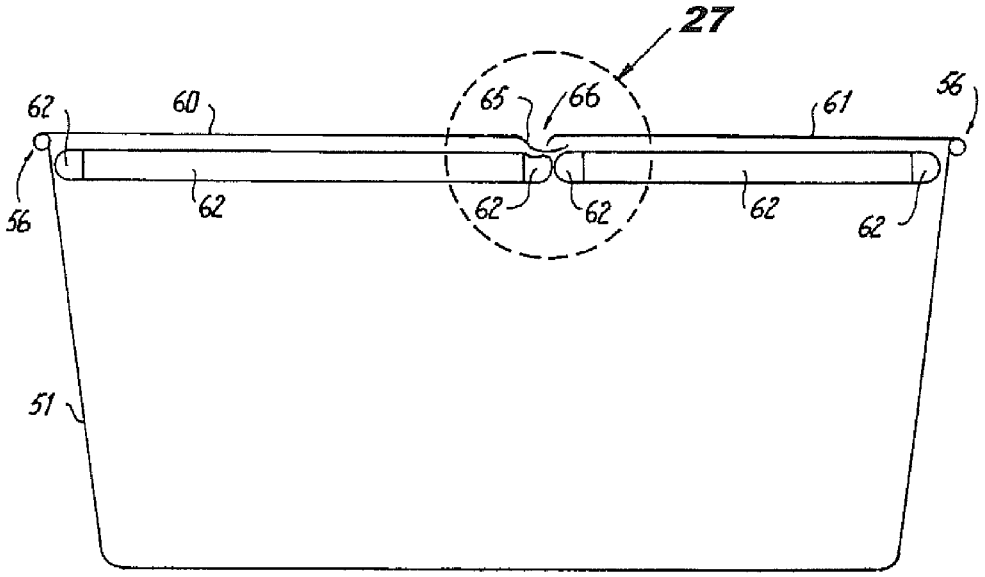
FIG. 26 is another alternative gasketed embodiment provided with two folding lids. In this embodiment there are two continuous gaskets so that each lid engages the continuous side wall, and the lid-lid interface upon closing forming a lip-seal.
Figure 27:
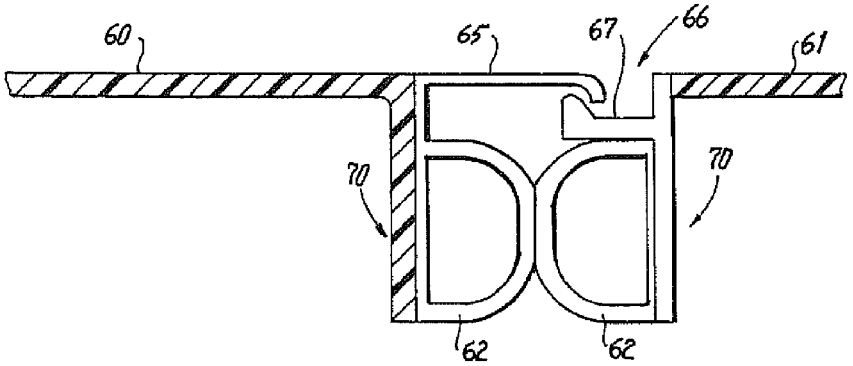
FIG. 27 is a close-up at view 27 in FIG. 26 wherein lid overlapping and gasket-gasket sealing is noted. An overlapping engaging member is provided as well as a drainage channel. The supports for the gaskets and the lid members are from more rigid plastic materials for ruggedizing utility.

In FIGS. 23-25 containment system 50 includes a container 51 and a single lid member 52. A continuously extending rim portion 53 projections along a top rim of container 51, as shown. A continuous extending elastomeric gasket member 54 is secured to an inner surface of lid member 52 and projects inwardly into container 51 or may optionally project from a flexible lid stalk 55 (FIGS. 24, 25) allowing a flexible urging continuously about gasket member 54 upon contact with rim 53 of container 51. An adaptive hinge construction 56 removably secures lid 52 on container 51 (FIG. 24). Alternatively projecting tab members 57 extend along an outer perimeter of lid 52 to allow a user-finger-lifting engagement for removal of lid 52.

As will be appreciated from FIG. 25, section B, with continuous lid 52 and overlapping tab members 57 spills drain readily off container 51. As will be also understood by one of skill in the art having studied the enclosure, profile rim 53 may be shaped to complement and receive a profile of gasket 53 to provide a secure sealing engagement and optionally a snap-fit type engagement.

Referring now to FIGS. 26 through 29 further optional and alternative gasket-related embodiment are presented, here as shown, with lid members 60, 61, e.g, where a silicone or other gasket is provided on a rim or on a lid for further air and water resistance. As will be readily understood, respective lid gaskets 62, 62 are provided about an entire inner surface of each respective lid 60, 61 so as to simultaneously and sealing engage container rim 53 and the respective proximate portions of lids 60, 61, as shown.

A covering projection 65, extending from lid 60 provides a covering for lid-lid interfit gasket connections (FIG. 27), and simultaneously engages a channel projection 66 extending from lid 61, as shown thereby creating a channel 67 to enable similar spill resistance as discussed earlier. As will recognized by one of skill in the art, respective lid projection portions 70, 70 for lids 60, 61 provide an urging resistance to gaskets 62, 62 proximate the lid-lid interface and thereby provide a continuously urged gasket seam.

Figure 28:
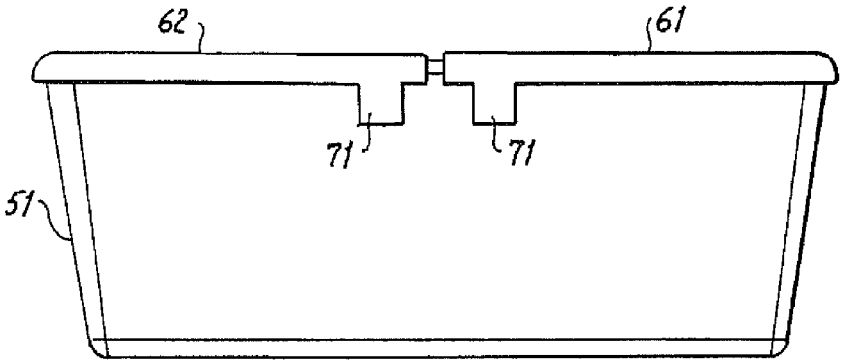
FIG. 28 is another alternative gasketed embodiment where side locking tabs projecting from each lid member are depicted for easy hand-access during use, thereby enabling further locking urging compression.

Referring now directly to FIG. 28, the earlier discussed rim 57 includes two additional locking projections 71, 71 for respective lids 60, 61. As will be understood from studying the current disclosure rim 53 may be complementarily shaped to provide a locking engagement with locking projections 71, 71 thereby further securing respective lids 60, 61.

Figure 29:
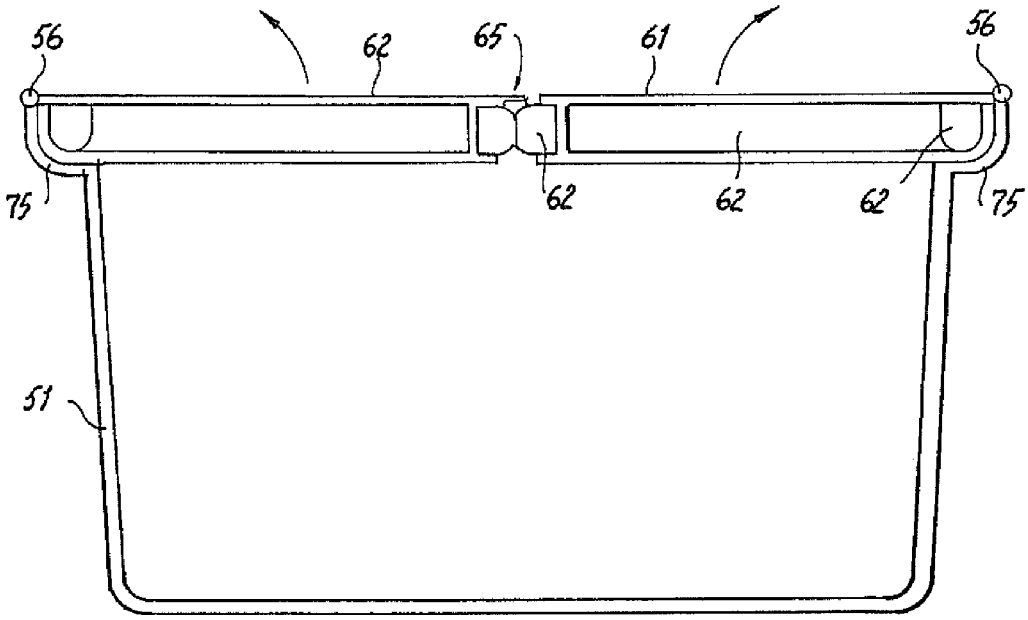
FIG. 29 is another alternative gasketed embodiment wherein side walls of the container are shaped to form top hinges and a continuous gasket is provided for each lid resting (compressed) into the shaped container side wall profile for locking urging compression.
Figure 30:
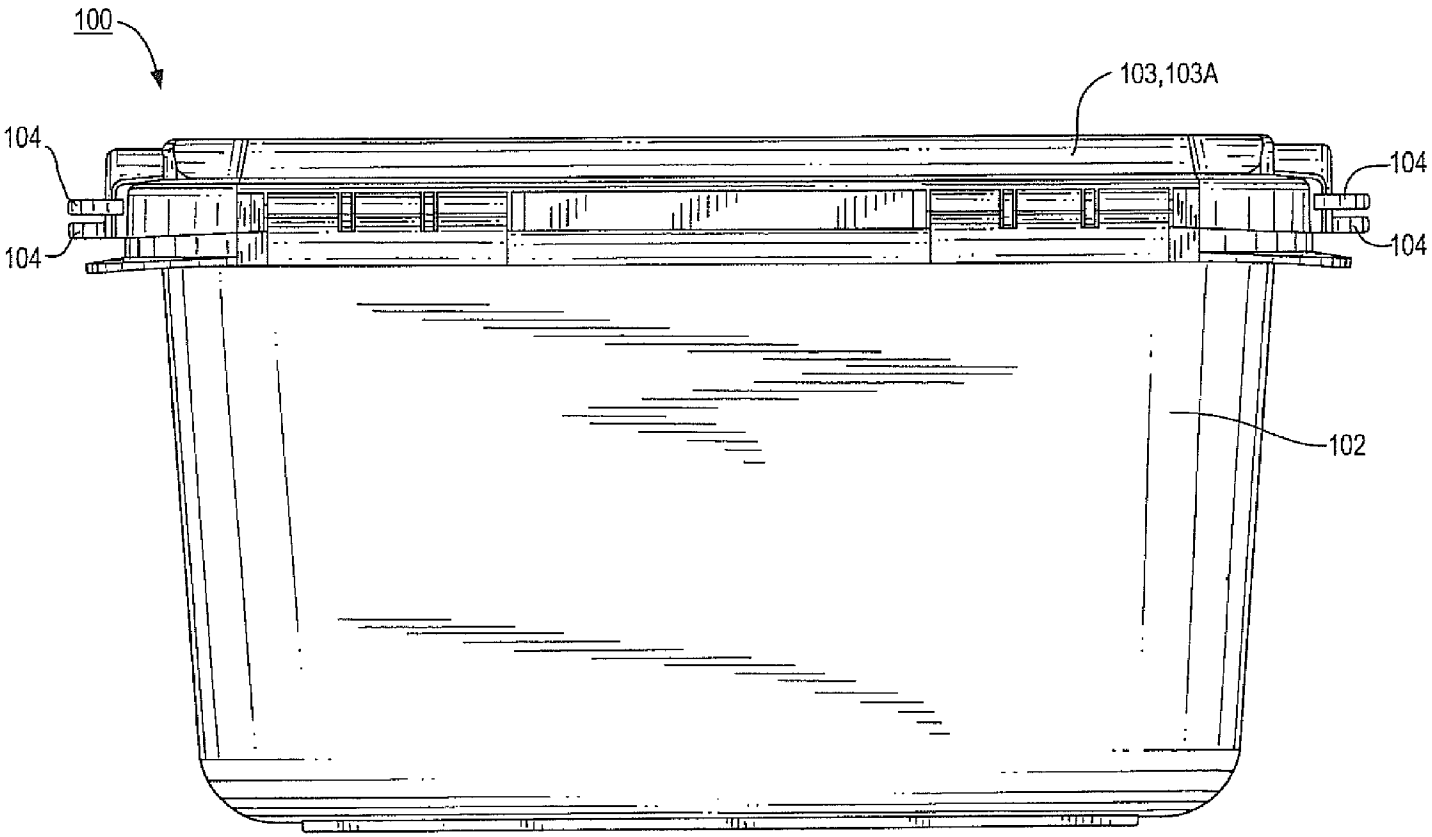
FIG. 30 is a side elevation view of a further alternative embodiment of the present invention.
Figure 31:
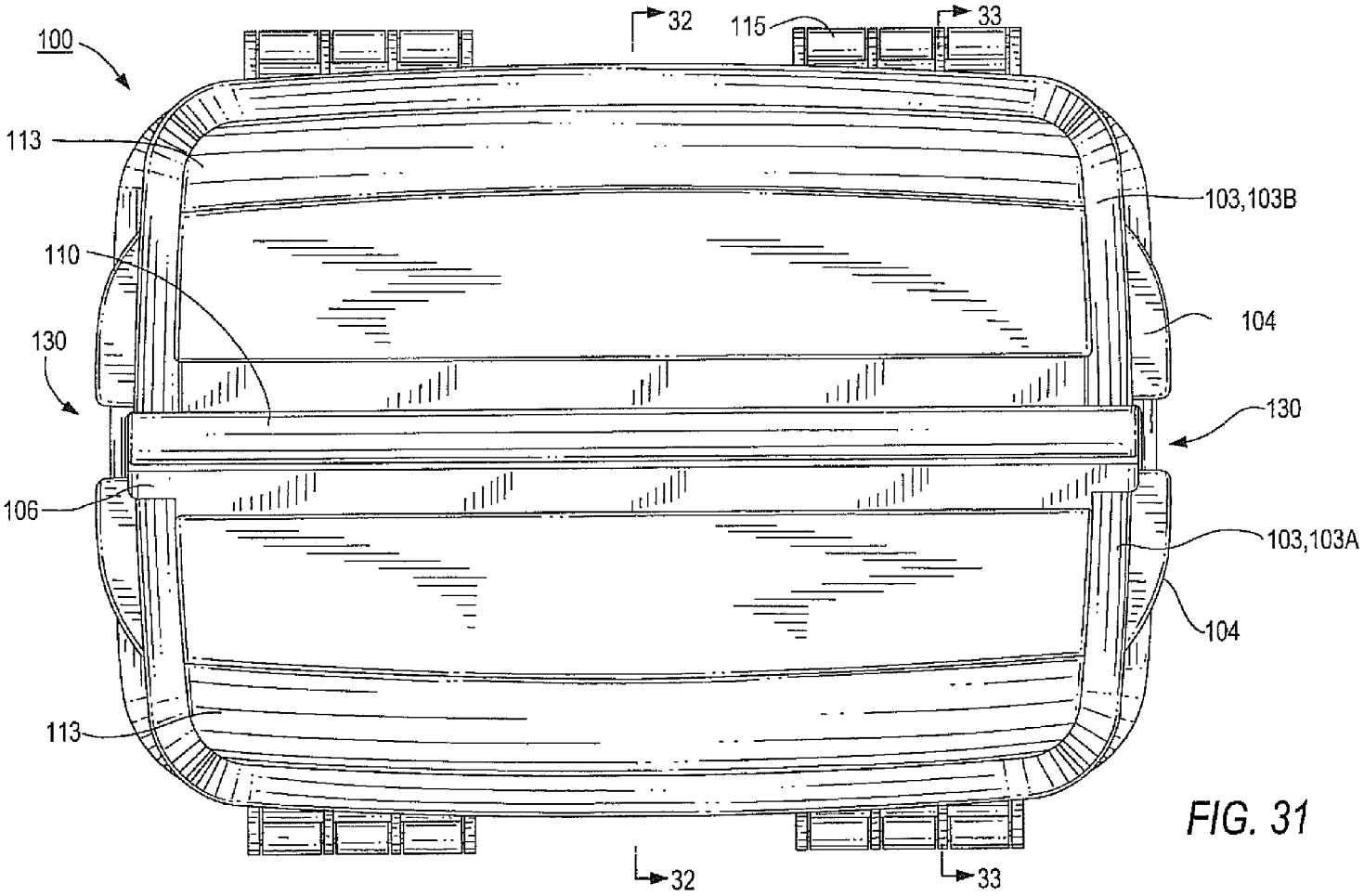
FIG. 31 is a top plan view of FIG. 30 noting section line orientation.
Figure 32:
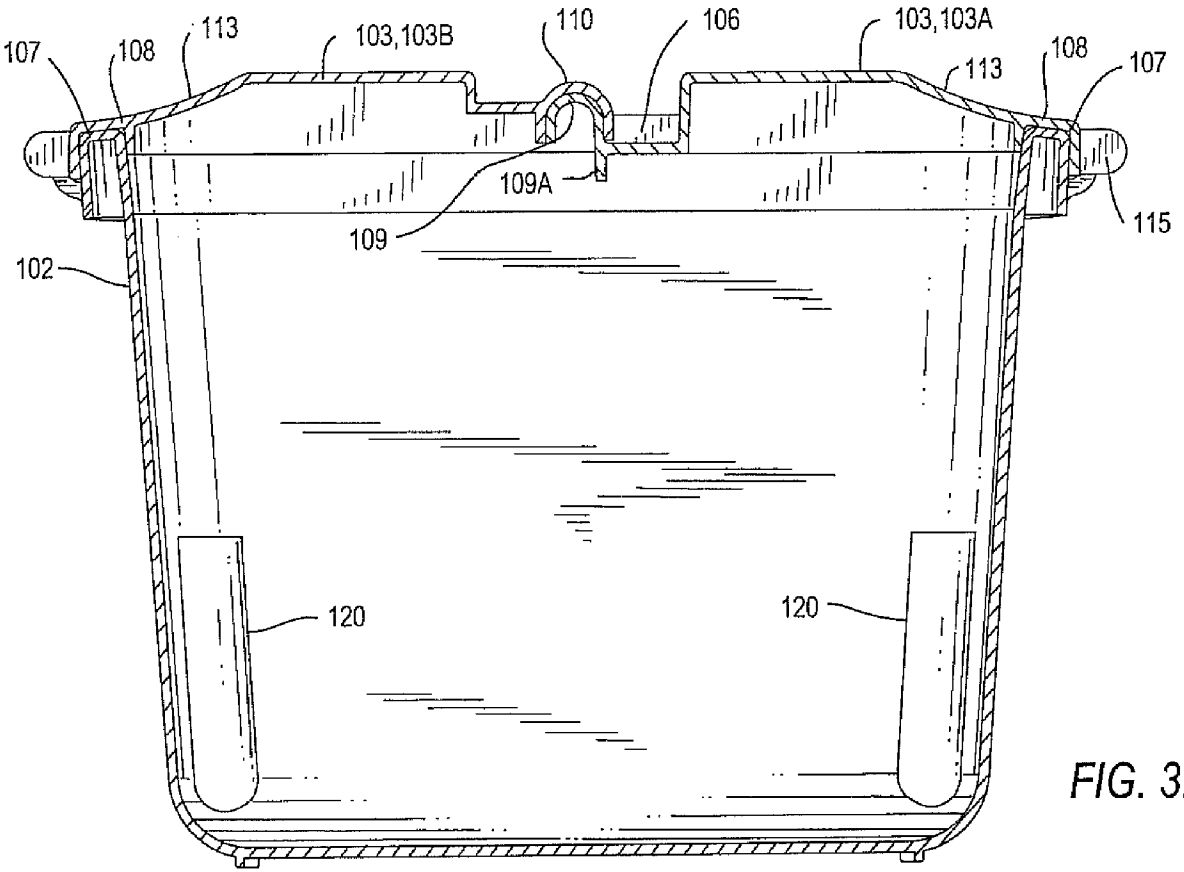
FIG. 32 is a middle section view along Section 32-32 in FIG. 31.

Referring now additionally to FIG. 29, container 51 now adaptively is formed with an alternative rim profile 75 formed as a curved channel (as shown). Curved channel 75 is now a 'female' profile and receives the 'male' gasket profile continuously about the outer periphery of container 51. Similarly a gasket-gasket sealing interfit exists along the lid-lid edges.

Referring now to FIGS. 30 to 39 an optional and alternative embodiment of the present invention is provided of a staged sealing containment system 100 including a container 102 having a lid system 103 shown as a bottom lid 103A and a top lid 103B. Respective lids 103A, 103E are shaped in a continuous profile about an outer periphery and along an inter-lid-interface as will be discussed. A closing handle 104 on each lid 103A, 103B, which may include a snap closing feature (not shown here but discussed earlier and incorporated herein) 4 projects from lids 103A, 103B in this embodiment. A channel profile 106 is provided on bottom lid 103A in a manner as will be discussed. It will be recognized that containment system 100 may take any alternative embodiment in keeping with the spirit and scope of the present invention. Alternative hinge mechanisms 115 are presented on either lid side, and consist similar to the hinge system shown in FIG. 14A but with an integral pin member and optionally with either friction resistance or an integral detent-type system to hold respective lids 103A, 103B in a user-designated position for ease of use.

Figure 35:
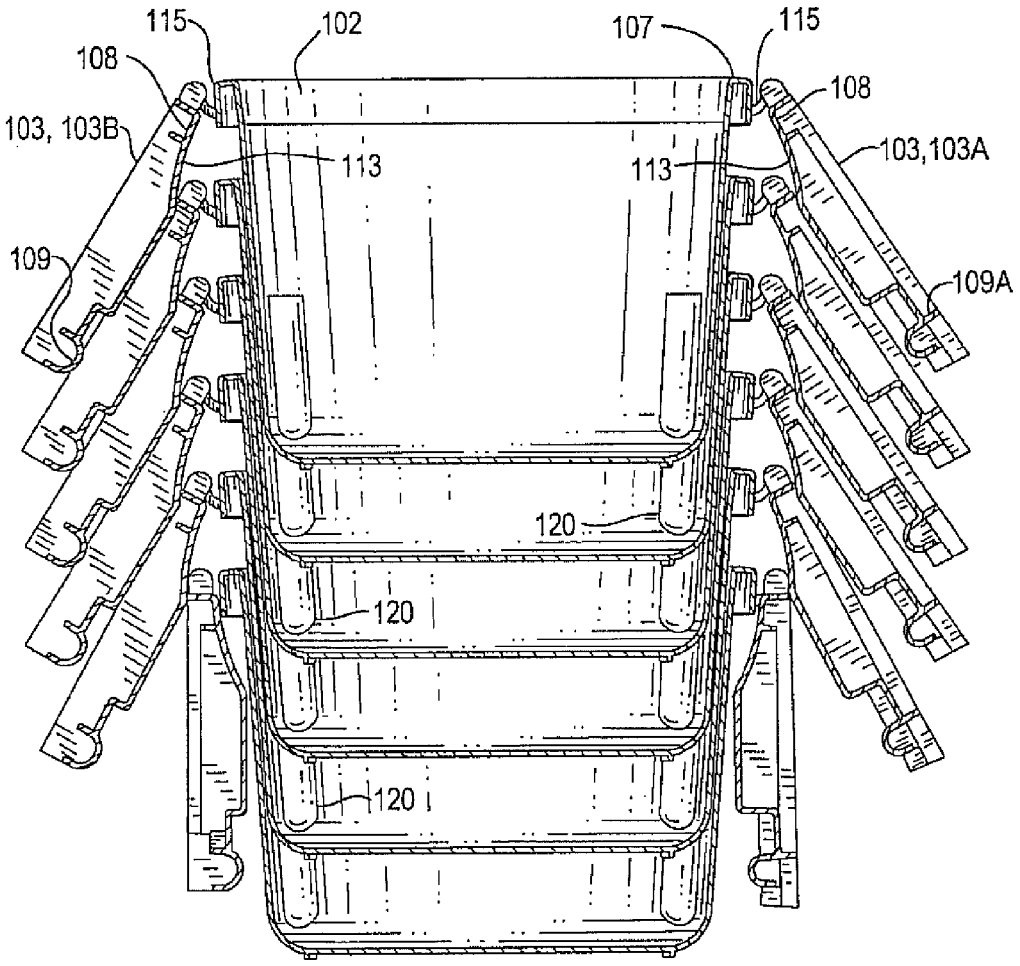
FIG. 35 is a sectional view along section 35-35 in FIG. 34 noting the lid clearance arrangement.
Figure 36:
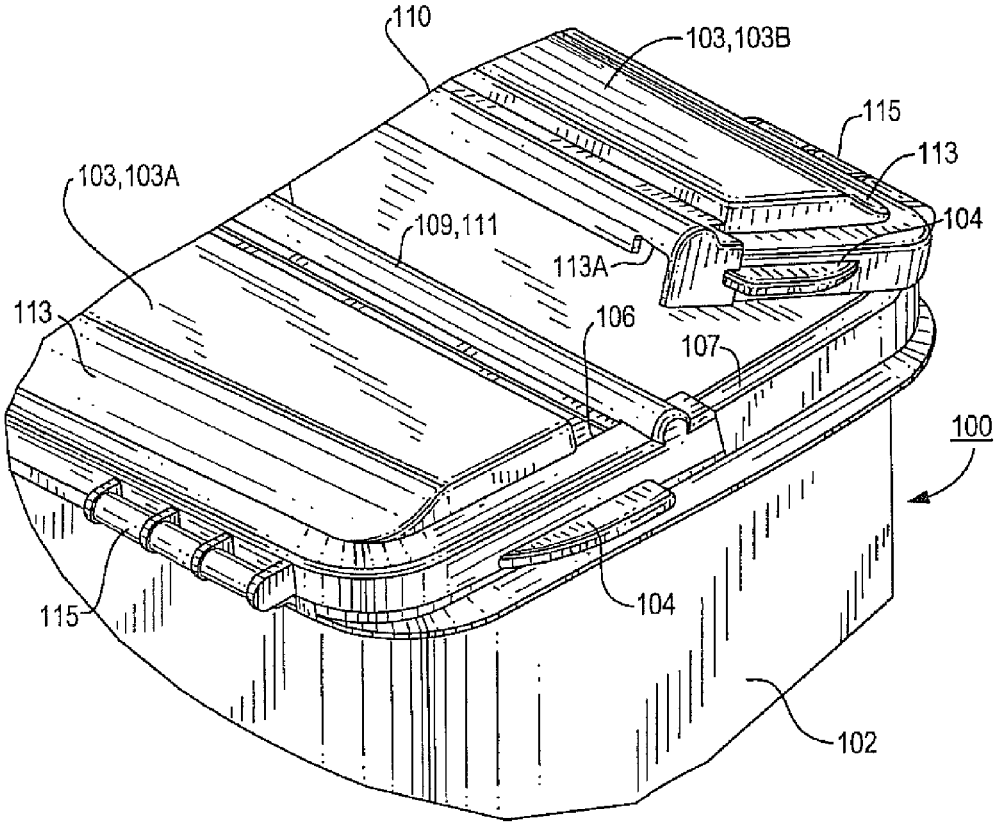
FIG. 36 is a partial perspective view of the embodiment as in FIG. 30 shown with a top lid partially open (held by a detent mechanism molded in the hinge mechanism) and a lower lid sealed around the rim of the bottom container perspective underside geometry for sealing with the lower lid and with the rim in a sealed and locked condition.
Figure 37:
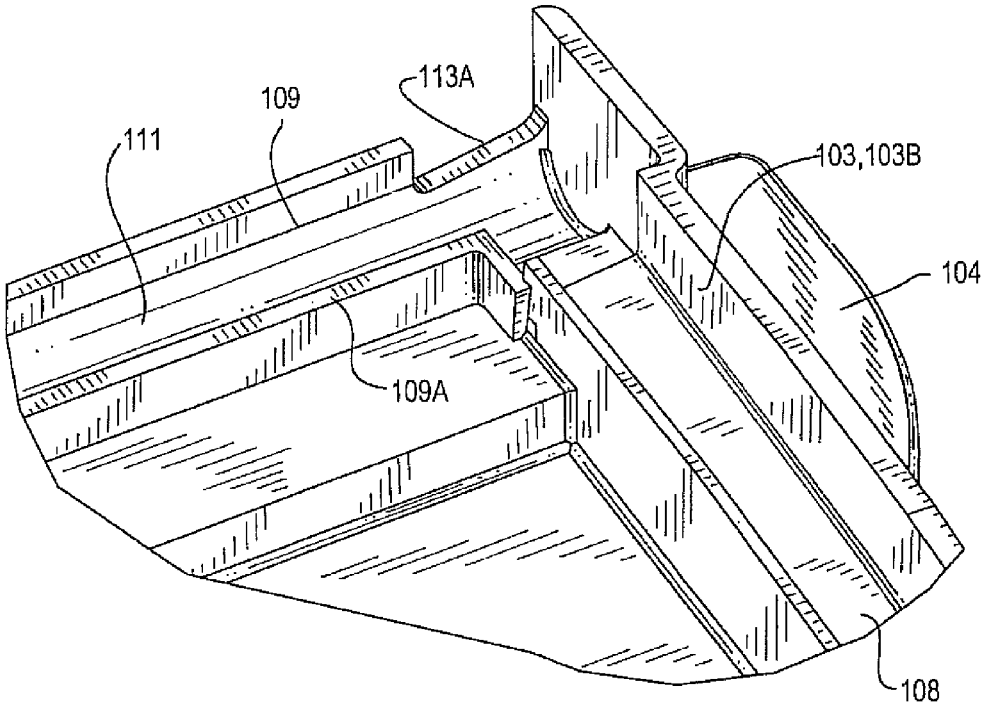
Figure 38:
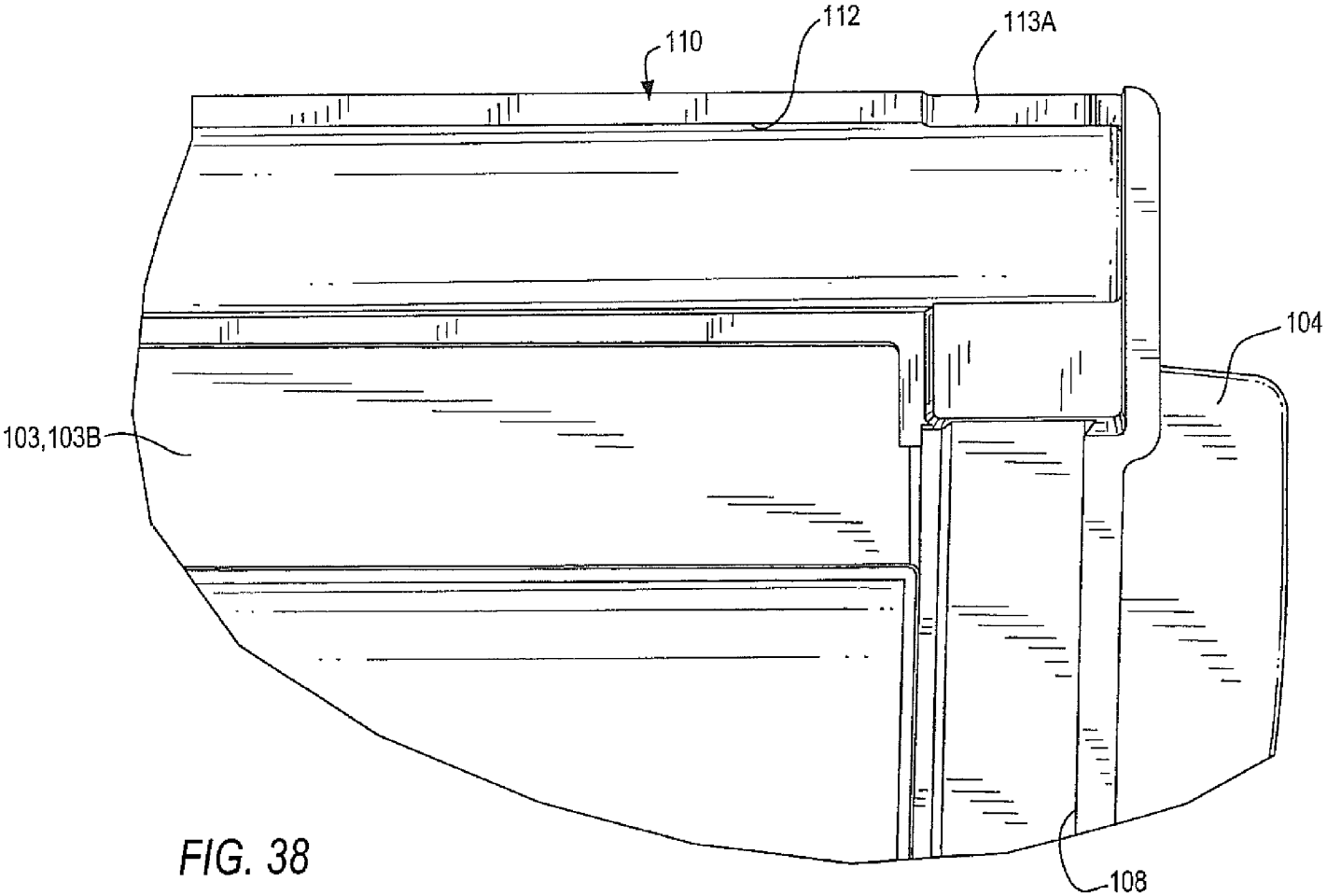
FIG. 38 is a partial underside plan on the top lid of FIG. 37 noting the intersection of the sealing geometries of the present invention.
Figure 39:
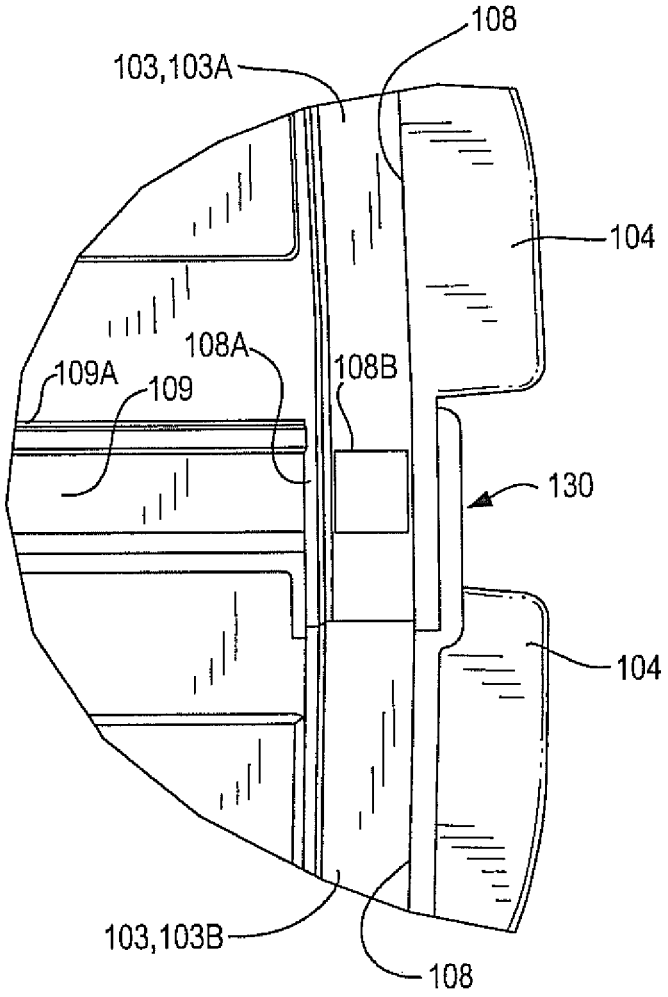
FIG. 39 is a partial underside plan view of the top lid and bottom lid sealed together (shown without the bottom container) noting the continuous container rim, and the sealed and locked together condition.

Referring directly now to FIGS. 36-39, containment system 100 is shown with a partial opening of lids 103A, 103B wherein bottom lid 103B is in a closed position (FIG. 36). As will be understood, this embodiment illustrates a stepwise or sequenced closing. Container 102 includes a formed rolled upper continuous wall or rim 107 forming a male or positive surface, as illustrated in cross sections (FIGS. 32, 33) and in each open view (FIGS. 35, 36). Each lid 103A, 103B includes about a side portion a respective continuous female or negative surface profile 108 that has a complementary profile as to continuous rim 107, such that in a closed position there is a connective urging interfit about the entire top of container 102. Here, the profiles are rectilinear (generally three-sided) such that the receiving female profile 108 is slightly tighter than the continuous male profile 107 thereby providing a tension during a pressing interfit using handles 104. Because rim 107 and profiles 108 on each lid 103A, 103B are continuous about an outer rim region the outer seal is continuous in a closed position. It will be also understood that an optional gasket (not shown) in the form of a soft silicone molded member may be along profile 107 or inside profiles 108 for further air and water sealing without departing from the scope and spirit of the present invention.

Bottom lid 103A is formed with a male profile projection 109 which similarly extends or spans along the entire lid-lid interface distance to each rim-side of rim 107. Additionally a strengthening rib member 109A extends further along projection 109 and channel portion 106 on lid 103A (bottom lid) to add substantial rigidity. As will be understood, rib member 109A is integrally joined with profile 108 on each side of lid 103A and thereby, when under pressure from stacking for example, transmits such stress and resists the same via firm connection to profiles 108 and thence to rim 107. In this way, the strength of lid member 103 is substantially improved.

On top lid 103B is a complementary female receiving or negative surface profile 110 shaped to operably receive the outer surface of projection profile 109 on bottom lid 103A for a continuous interfit that spans the entire container 102. As will be also understood complementary bottom edge outer surface profile 111 and inner top lid inner profile 112 are noted on respective lids so that at the interface between each lid edge the profiles both squeeze onto each other, but also aid in squeezing rim profile 107, to effectuate an operative continuous urging at each interface. So that there is no-connection between the inner projection profiles 109, 110 as they approach respective rim profiles 107, on each end of bottom lid 103A (see FIG. 39) is a blocking member 108A formed continuously with profile 108. A further recess 108B is formed (see FIG. 39) between blocking member 108A and the outer side of profile 108 to avoid requiring excess material or plastic to fill the difference in profile crossing with ending profile 109, 112 where it crosses over rim 107.

There is additionally, a cut-out region 113A on either side of top lid 103B member to allow receipt of profile 109 during closing (best seen in FIG. 36). In this manner, members 109, 109A, 110 extend and match bottom and top lids 103A and 103B with the rim profile 108 and rim 107. In this way the channel-rim system 107, 108 is fully operably separated from the lid-lid interface 109, 110 but operates together therewith. Additionally as a result, pressure applied along the lid-lid interface (when closed) is transferred to the rim 107 without causing the lid-lid interface to separate.

Additionally, as noted in these figures, there is a to lid profile region 113 on each lid 103A, 103B. In combination, these lid profile regions 113, in combination with a projection distance from hinges 115 allow (as best seen in FIG. 35) a plurality of open lids 103 to interstack without interference and rising/stacking above a top level of rim 107. This aids condensed packing and shipping storage. However, tight packing also makes separation difficult, and as a result, a plurality of standoff members 120 are positioned—shown here in each corner of container 102. Stand off members 120 are not restricted to shape, size, or location, but are integrally molded with container 102 and are approximately (in this embodiment) 2-3 mm thick to allow separation between outer and inner walls of containers 102—and thus blockage of any vacuum there between that would prevent easy separation.

Referring now to FIGS. 33 and 37-39 it will be understood the side walls of profile 108 may be further modified to interfit at a lid-over-lap region that extends from profile 107 to profile 107 and begins at a lid-edge 130 (see FIGS. 33, 39) to a lid-edge 103. It will be understood that lid profiles 108, 109, and 110, and their related surfaces may include shapes that interlink as snap-connections or lips to engage rim 107.

Figure 33:
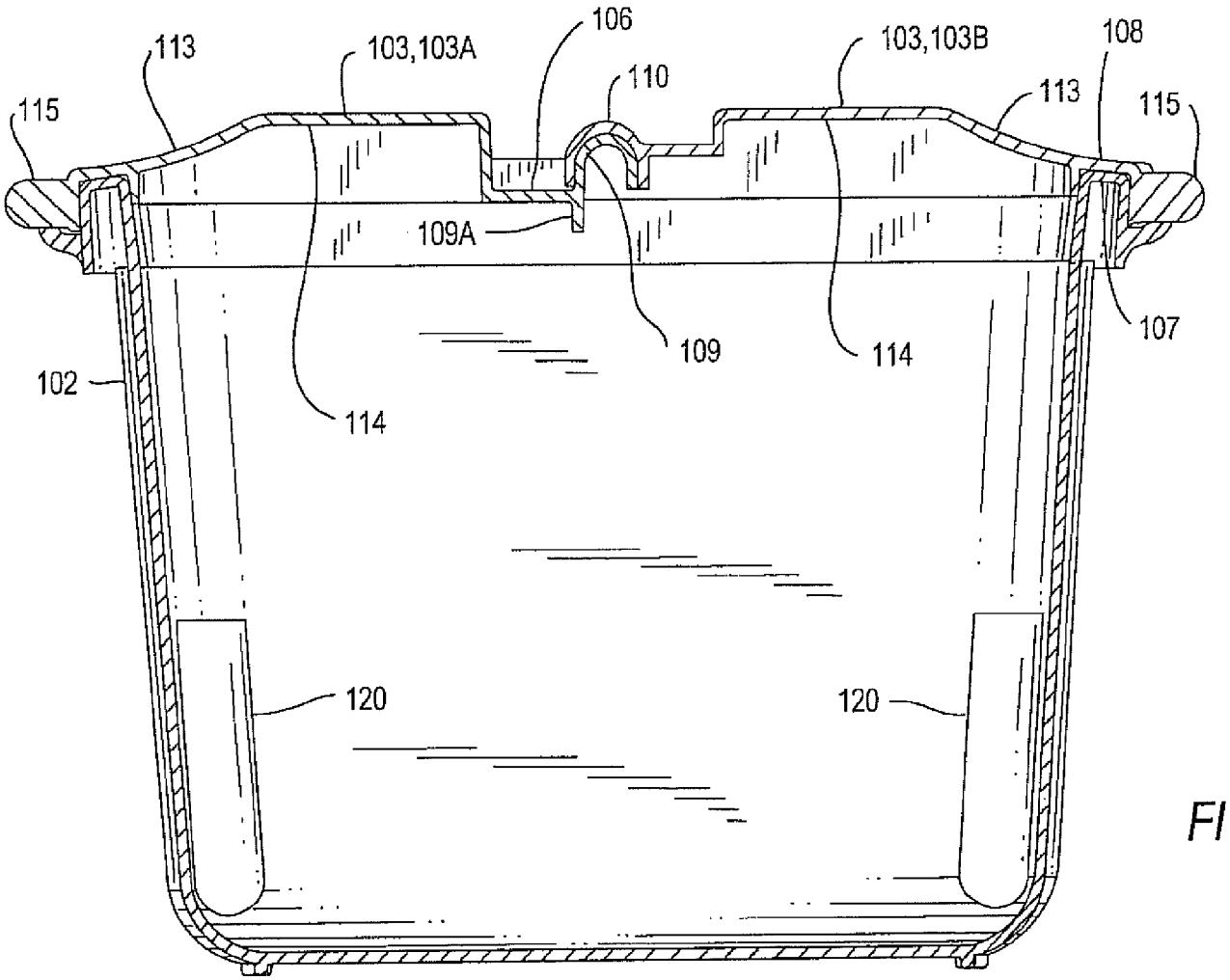
FIG. 33 is a hinge section view along Section 33-33 in FIG. 31.
Figure 34:
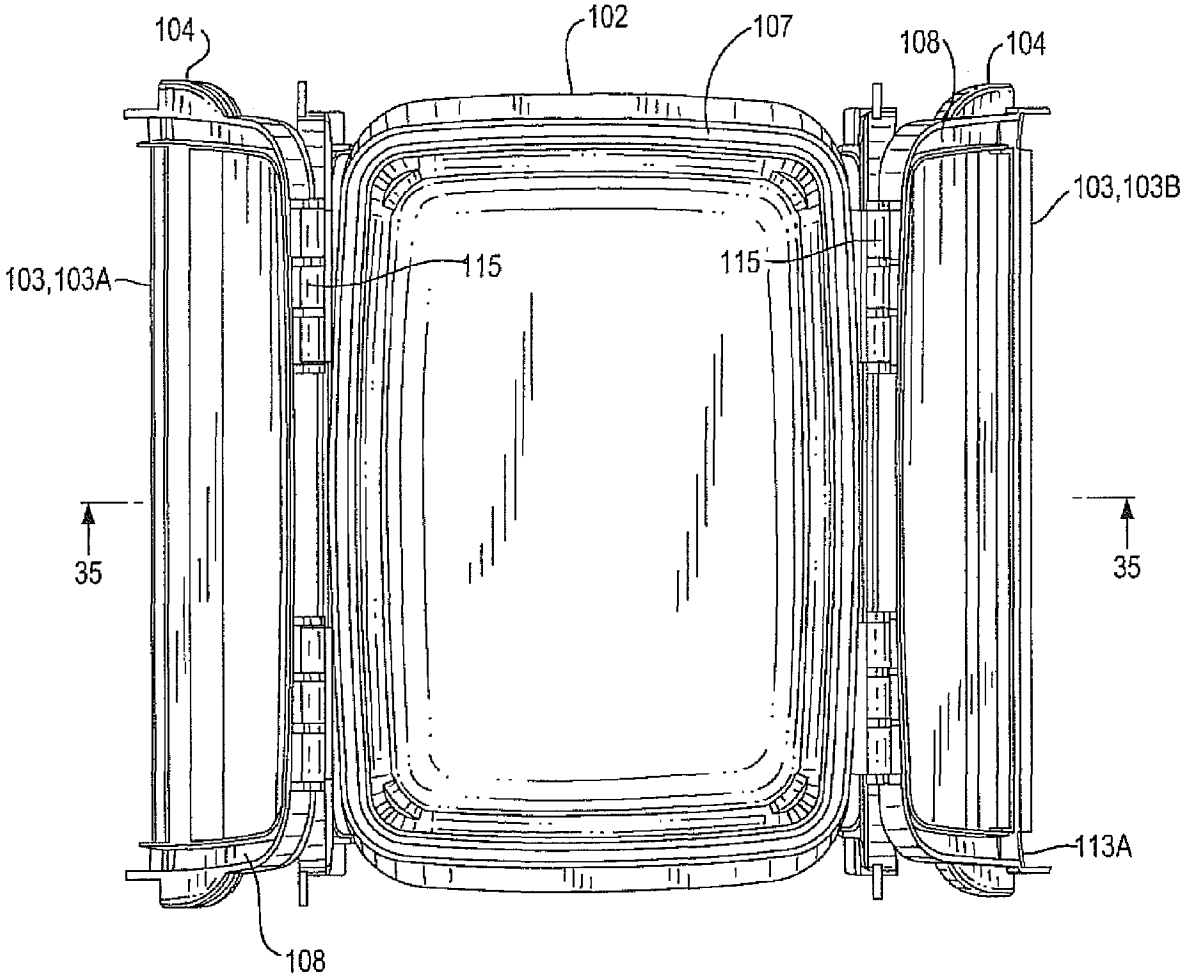
FIG. 34 is a top plan view of a series of stacked alternative embodiments as in FIG. 30 with open lids, showing the lid arrangement allowance geometry.
Figure 40:
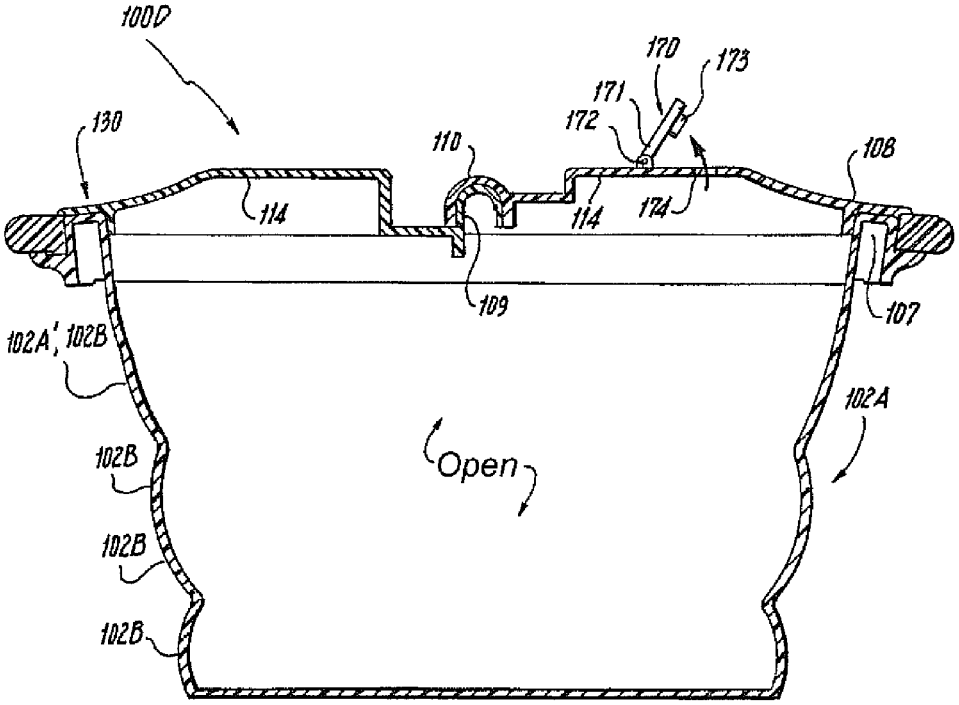
FIG. 40 is an exemplary embodiment for a compactable or volume-flexible system having a sealing top according to another aspect of the present invention in an open condition.
Figure 41:
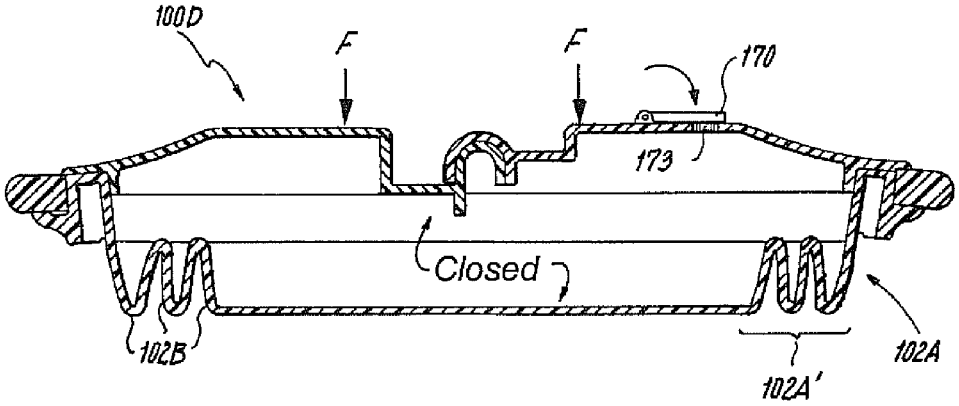
FIG. 41 is an exemplary view of FIG. 40 shown in a compacted or compressed condition where the compaction section is compressed leaving a volume remaining in the container.
Figure 42:
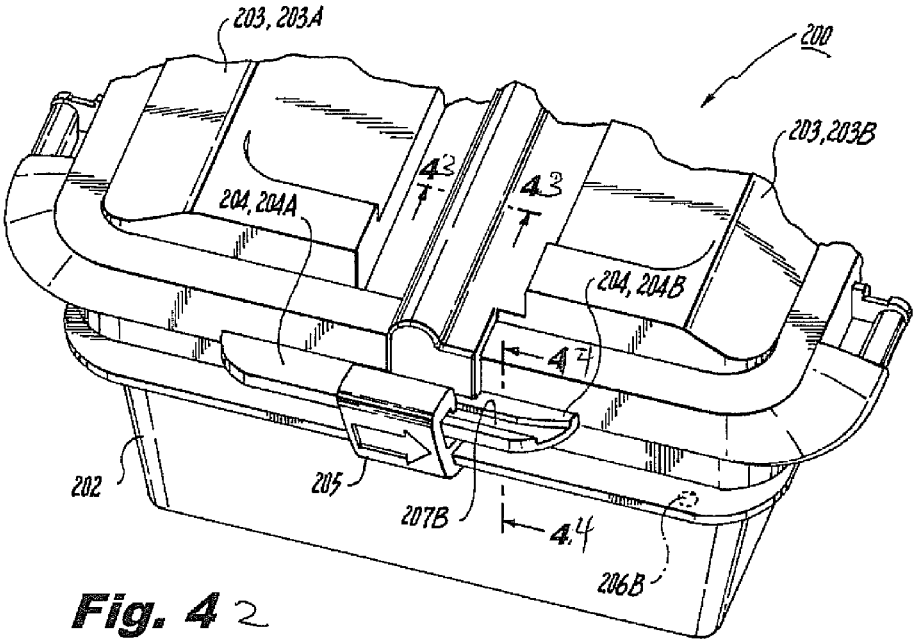
FIG. 42 is a perspective partial view of another exemplary embodiment of the present invention providing a sliding locking system.

Referring now to FIGS. 40 and 41, a further embodiment 100D as a collapsible base container, includes similar top portions, similar in some aspects to FIGS. 33-39 above, and so will be understood to include similar side walls of profiles 108 shown as earlier in FIG. 33 to interfit at a lid-over-lap region that extends from profile 107 to profile 107 and begins at a lid-edge 130 (see FIGS. 33, 39) to a lid-edge 103. It will be understood that lid profiles 108, 109, and 110, and their related surfaces may include shapes that interlink as snap-connections or lips to engage rim 107.

In embodiment 100D, a base container 102A includes a formed side wall portion 102A' having a plurality of stress releasing portions 102B (here five portions 102B are shown but the concept is not limited thereto), each with a living hinge formed therebetween, and a respective rigid bottom support and top lip portion as earlier discussed. This is capable of achievement via co-molding using conventional materials, now used for collapsible cooking vessels, for example as shown in U.S. Pat. No. D652,745, the entire contents of which are incorporated herein by reference. FIG. 40 shows base container 102A with walls 102A' in an 'open' condition and FIG. 41 shows base container 102A with walls 102A' in a collapsed/closed condition, thereby saving space. Container wall portions 102A', 102B may be formed of any suitable flexible material, for example silicone, or blend of any suitable materials sufficient to provide a self-supportive container when open, and to flexibly collapse prior to storage. The system 100D provides collapsible storage capability and may be adapted to any shape container (round, conical, rectangular, square, etc.) and to varying heights (tall, short) and with varying flex-sections 102B, depending upon the desired features by the manufacturer. For example, round embodiment (FIG. 15) may be readily adapted to employ the collapsible features herein.

One of the non-limiting specific benefits to embodiment 100D is that previously presented collapsible vessels did not withstand compression, for example during stacked packaging where the contained weight of one container urges collapse of the vessels below. Using the present invention, the well sealed top geometry, rigid rim and profile, and rigid bottom seal container 100D, and thus effectively prevent unintended collapse by containing the pressured volume therein. This allows for enhanced preservation and storage of materials. As a result, it will be recognized that a pressure-relief system 170, in the form of a hinged pressure closing valve (see FIGS. 40, 41) will allow pressure to escape upon compression. Pressure-relief system 170, in the embodiment shown, includes a lid 171 rotating about a hinge 172 and a plug 173 rotating relative to an opening 174 on lid 114. It will be understood that pressure-relief system 170 may be in the form of a one-way valve, an openable valve, a removable plug, and in other means operative to selectively allow gas to escape from the bounded inner volume upon user-determination but not upon accidental release.

Referring now to FIGS. 42-49 a further adoptive embodiment 200 is discussed herein for a containment system having a lid system 203 with respective lid sides 203A, 203B, as shown operative on hinges (earlier discussed) to bound a container or bin 202. As discussed each lid has respective geometries for interfitting (see FIG. 43) wherein an engaging lip 209 on lid 203B interfits with a receiving sealing lip 208 of lid 203A during a closing use thereof.

Figure 43:
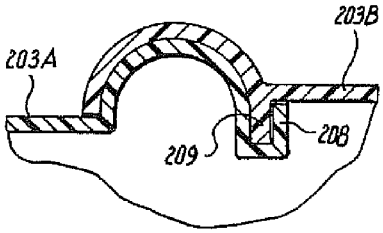
FIG. 43 is a partial cross-sectional view along section lines 43-43 in FIG. 42 illustrating an additional sealing lip portion for additional strength and sealing enhancement.
Figure 44:
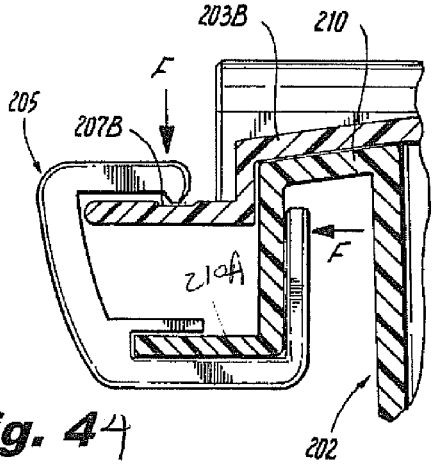
FIG. 44 is a partial cross-sectional view along lines 44-44 in FIG. 43 illustrating a cross sectional engagement of the sliding lock system in FIG. 42 wherein a positive urging connection is secured between protuberances from the lids and the base container.
Figure 45:
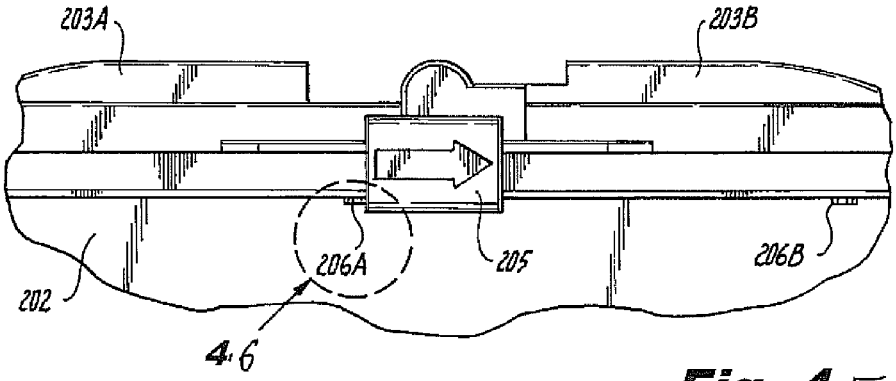
FIG. 45 is a partial side view of FIG. 42 noting the operative position of the slide lock portion in a locked condition, and blocking members to prevent unintended over-sliding.
Figure 46:
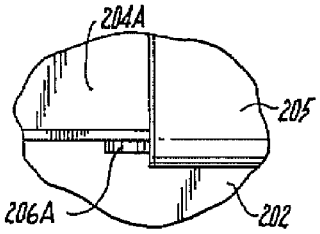
FIG. 46 is a partial view of portion 46 in FIG. 45 where a close-up is provided of one of the blocking members
Figure 47:
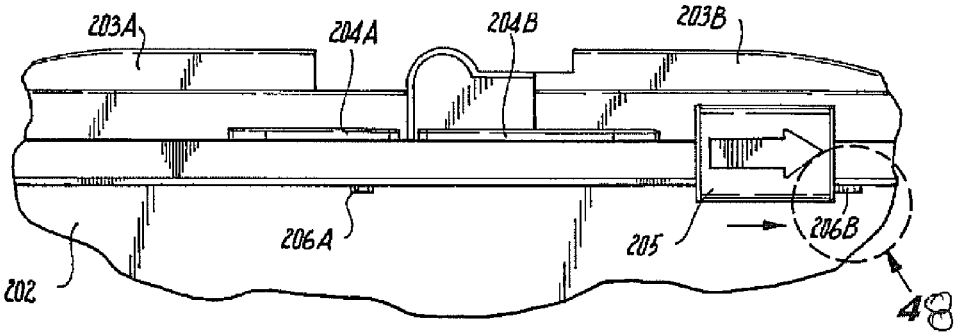
FIG. 47 is a partial side view of FIG. 42 noting the operative positions of the slide lock portion in an unlocked condition, with the blocking members noted to prevent unintended over unlocking-sliding.
Figure 48:
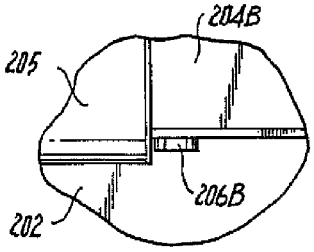
FIG. 48 is a partial view of FIG. 47 where a close-up is provided of one of the blocking members.
Figure 49:
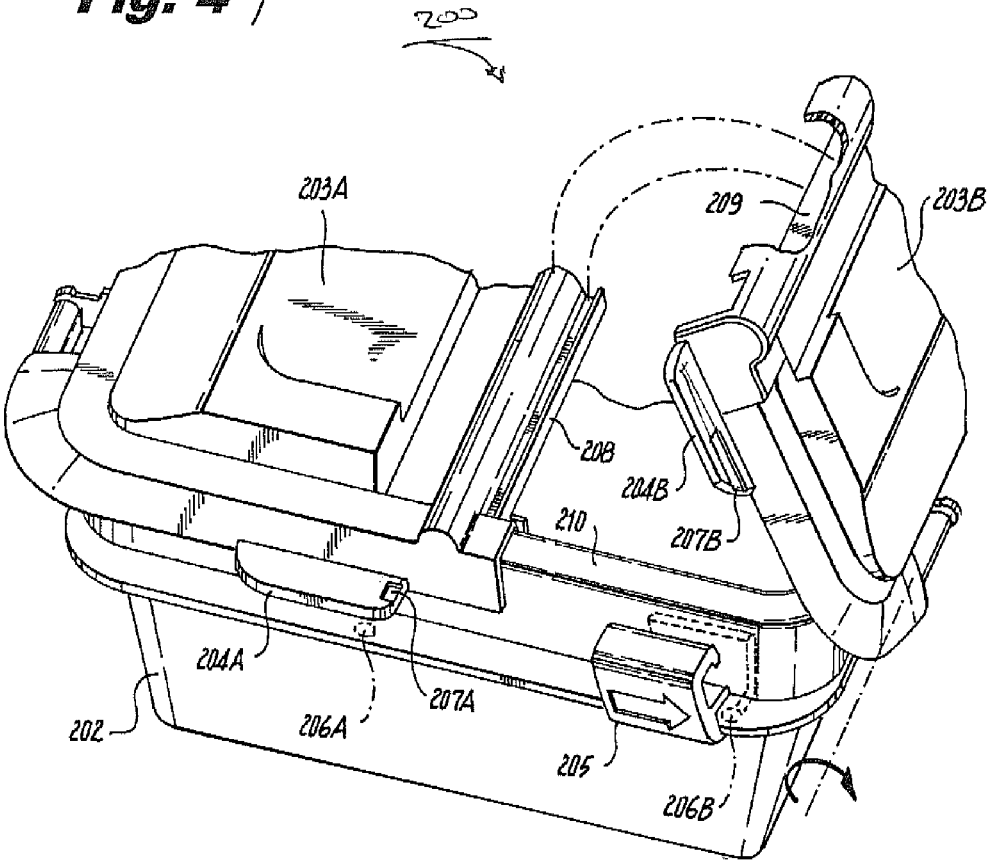
FIG. 49 is a perspective view of FIG. 42 in an partially open condition and unlocked condition illustrating the sliding lock motions and the additional sealing lip feature.
Figures 5A, 5B, 5C, 5D:
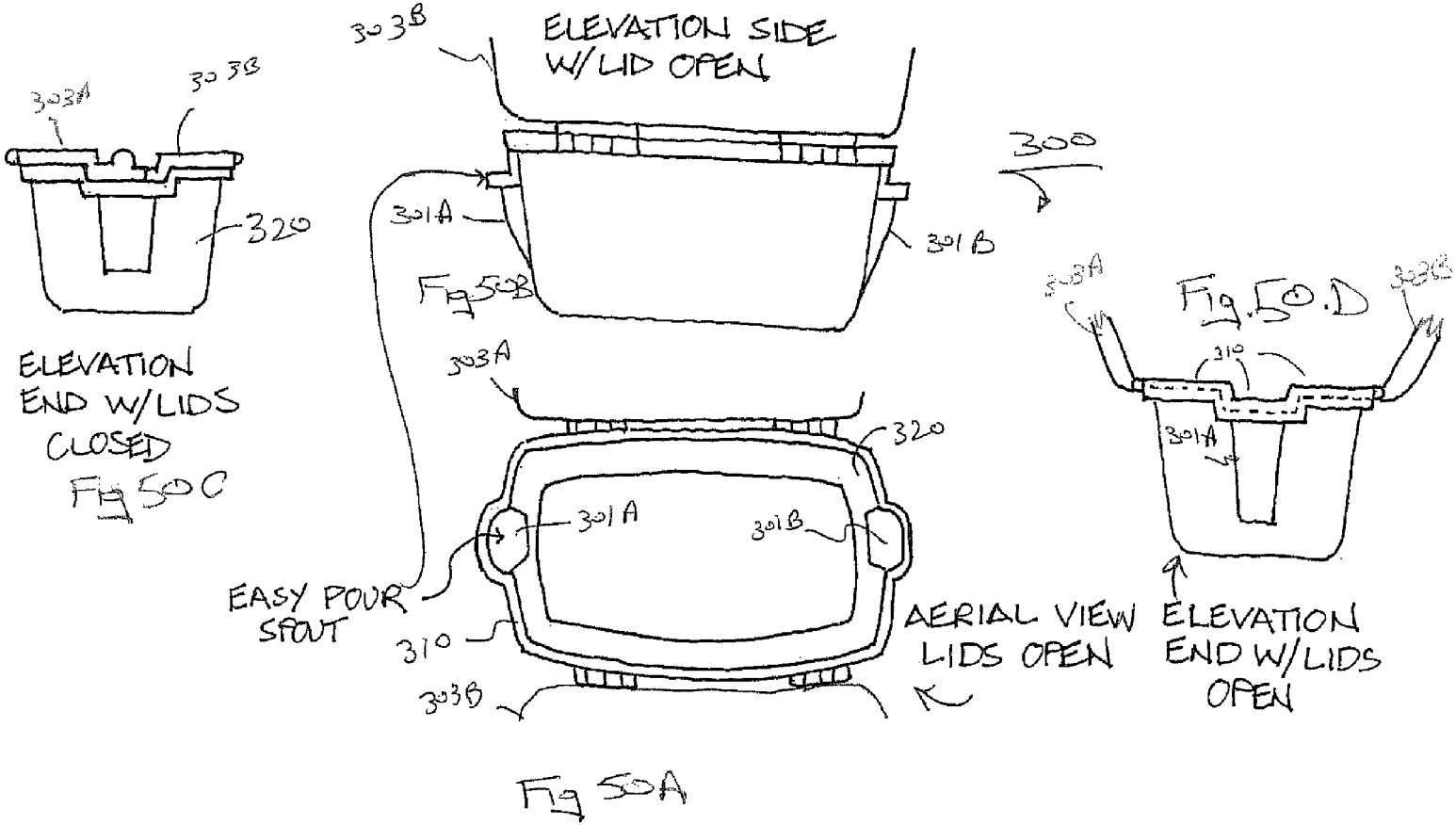

As will be understood particularly with consideration of FIGS. 49 and 43, the additional interfitting and sealing action of engaging lip 209 and sealing lip 208 respectively on lid system 203 provides an additional 'double' type seal in addition to the entire arc-shaped seal already in place (the left side of FIG. 43 and discussed earlier). This additional sealing operation allows additional engagement and strength of the lid-lid interfit to prevent bursting and distortion during heating, cooling, or with heavy-weight use.

FIGS. 44 and 45-49 note an additional sliding-lock system feature where a sliding clip 205 slides relative to respective handles 204, including 204A, 204B protuberances from each lid, and to respective rim portion 210 and rim protuberance 210A. In a 'closed' position respective protuberances 204A, 204B and 210A are proximate each other, and clip 205, which is captive on 210A can slidably lock each lid 203A, 203B via force F vector (see FIG. 44) to container bin 202 by relative sliding of clip 205 between respective closed-and-open stop members 206A, 206B. Respective stop members 206A, 206B prevent the overtravel of clip 205.

Additionally, to enhance user convenience, slight guiding grooves 207B and 207A are provided on respective protuberances 204A and 204B of each lid member thereby allowing a guiding ease of the clip 205 over respective protuberances. Since clip 205 is in a 'C'-shape it provides a spring closing urging force F that additionally resists opening and provides sealing as shown by the complete contacting of lid members and rim 210 to seal.

Referring not additionally to FIGS. 50A to 50D, an alternative embodiment of containment system 300 is provided with a bottom bin portion 320 having a continuous sealing lip 310 and opposing hinged lid members 303A, 303B. It will be understood, that the continuous sealing lip members and functions herein (discussed above, including sliding toe elements and other details) are incorporated in this embodiment by reference in alternative adaptations. What is noted here differently, is that a portion of the side wall of bin 320 is formed into respective pour spouts 301A, 301B to aid dispensment of the contents of bin 320. It will be understood, that the pour spout features herein are adaptations of the proposed invention and may be adaptively integrated to the other embodiments noted herein. For example, in a non-limiting way, a single pour spout geometry may be provided for a round container, or one of a different shape (pointed, broader, with teeth-formations, etc.) without departing from the scope and spirit of the present invention.

As will be understood by those of skill in the art, the phrase positive compressive urging or urging or snap lock or respectively positive compressive means, is indicative of an arrangement where a positive (greater than zero) spring compressive force is generated between two respective contact regions pressing them together where the force is continuously urged. Thus, for a non-limiting example, a C-shaped member having a first inner radius is opened and then sprung-closed to secured about an O-shaped member having a second outer radius. To secure a positive compressive force, the first inner radius is close to but smaller than the second outer radius resulting in a continuous compressive urging (squeezing) about the O-shaped member.

The present invention is not restricted to the particular configurations described and illustrated. The described embodiments are not exclusive, and the scope of the invention includes further different configurations and structures. It is apparent that departures from specific structures and configurations described and shown will suggest themselves to those skilled in the related art and may be used without departing from the present invention. Accordingly, the invention should be construed to cohere with all modifications that may fall within the scope of the descriptions of the inventive features provided herein. For example, lid-lid interfit profiles are shown in several alternative embodiments, and are without limitation. Additionally, lid-profiles are shown with recessed or sloped regions proximate hinge mechanisms to allow multiple stacking without lid's rising above a rim.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A containment system, comprising:

a bounded container having a continuous rim;

a sealing lid system engaging said continuous rim;

an interfit profile mechanism for positive urging of said sealing lid system to said continuous rim, whereby said mechanism for positive urging enables an operative and continuous secure sealing of said sealing lid system to said bounded container;

at least one channel profile spanning at least a portion of said sealing lid system;

said channel profile including a recessed passage defined as recessed relative to an upper surface of said sealing lid system, whereby external materials received on said sealing lid system transit through said recessed passage away from said sealing lid system and said continuous rim of said containment system;

said sealing lid system, further comprising:

at least a first lid member and a second lid member;

said means for positive urging, further comprising:

a lid-sealing between said at least first lid member and said second lid member, whereby said means for positive urging enables said operative and continuous secure sealing to include a continuous inter-lid seal;

said lid-sealing between said first lid member and said second lid member, further comprising:

first flex-lid locking means for means for locking said first lid member to said second lid member in said continuous inter-lid seal;

said first flex-lid locking means including an extending flex-lid tab member extending from one of said first and second lid members toward said other lid member and being formed of a resilient material;

one of a male and a female catch member on said one of said first and second lid members;

said other of said male and female catch member on said other of said first and second lid members; and said extending tab member being proximate said one of said male and female catch members, whereby during a use a flexing of said extending tab member disengages said male and female catch members and an urging return flex of said extending tab member re-engages said male and female catch members operative to engage said means for locking said first lid member to said second lid member in said continuous inter-lid seal.

2. A containment system, according to claim 1, further comprising:

hinge means pivotably operative between said bounded container and at least one of said lid members enabling said at least one of said lid members to transit through a motion arc from a fully sealed position to a fully open position; and said hinge means includes friction means for enabling said hinge means to support said at least one of said lid members at at least one user-selected position along said motion arc relative to said bounded container.

3. A containment system, according to claim 2, wherein:

said means for positive urging of said sealing lid system operative to enable one of a simultaneous closing of said first and said second lid members and a staged closing of said first and said second lid members, whereby said continuous inter-lid sealing is maintained.

4. A containment system, according to claim 1, wherein:

said means for positive urging of said sealing lid system to said continuous rim, further comprising:

first flex-rim locking means for locking said sealing lid system to said continuous rim of said bounded container;

said first flex-rim locking means including an extending flex-rim tab member extending from said sealing lid system proximate said continuous rim and formed from a resilient material;

one of a male and a female catch member on said one of said first flex-rim tab member and said continuous rim;

said other of said male and female catch member on said other of said flex-rim tab member and said continuous rim; and said flex-rim extending tab member being proximate said one of said male and female catch members, whereby during a use a flexing of said flex-rim extending tab member disengages said male and female catch members and an urging return flex of said flex-rim extending tab member re-engages said male and female catch members operative to engage said first flex-rim locking means for locking said sealing lid system to said continuous rim in said continuous seal.

5. A containment system, according to claim 1, further comprising:

an extending gasket member continuously extending from said sealing lid system;

a receiving region on said bounded container proximate said continuous rim; and said receiving region having a shape operative to receive a portion of said extending gasket member during a use thereof; whereby said operative and continuous sealing of said sealing lid system to said bounded container is maintained.

6. A containment system, according to claim 5, further comprising:

an extending arm member projecting from said sealing lid system toward said continuous rim;

said extending gasket member proximate an end of said extending arm member; and said flexing arm member flexing during said use to disturb a resting position of said bushing into a sealing position in said receiving region and provide a continuous urging force during said use to maintain said operative and continuous sealing of said sealing lid system to said bounded container.

7. A containment system, according to claim 1, further comprising:

a dual sealing profile along said lid-sealing between said first lid member and said second lid member;

said dual sealing profile including a male projecting profile and a female receiving profile on respectively said first lid member and said second lid member.

8. A containment system, according to claim 7, wherein:

said dual sealing profile includes on said first lid member one of said male projecting profiles and one of said female receiving profiles and said second lid member containing respectively a first and a second female receiving profile;

whereby said lid-sealing between said first and second lid members includes an operative engagement of at least two interfitting sealing profiles.

9. A containment system, according to claim 7, wherein:

said dual sealing profile includes a gasket member on each of said first lid member and said second lid member;

whereby said lid-sealing between said first and second lid members includes an operative pressure engagement of said gaskets.

10. A containment system, comprising:

a bounded container having a continuous rim;

said bounded container having compactable side walls, thereby allowing a reduction in a volume of said bounded container during a compaction thereof;

a sealing lid system engaging said continuous rim; and an interfit profile mechanism for positive urging of said sealing lid system to said continuous rim, whereby said mechanism for positive urging enables an operative and continuous secure sealing of said sealing lid system to said bounded container;

at least one channel profile spanning at least a portion of said sealing lid system;

said channel profile including a recessed passage defined as recessed relative to an upper surface of said sealing lid system, whereby external materials received on said sealing lid system transit through said recessed passage away from said sealing lid system and said continuous rim of said containment system;

a plurality of cooperative side wall sections; and respective side wall sections and said bounded container being flexibly retained in a sealing manner operable to enable said container to change between a collapsed condition with said continuous rim proximate a container base and an open condition with said continuous rim distal of said container base;

said sealing lid system, further comprising:

at least a first lid member and a second lid member;

said means for positive urging, further comprising:

a lid-sealing between said at least first lid member and said second lid member, whereby said means for positive urging enables said operative and continuous secure sealing to include a continuous inter-lid seal;

said lid-sealing between said first lid member and said second lid member, further comprising:

first flex-lid locking means for means for locking said first lid member to said second lid member in said continuous inter-lid seal;

said first flex-lid locking means including an extending flex-lid tab member extending from one of said first and second lid members toward said other lid member and being formed of a resilient material;

one of a male and a female catch member on said one of said first and second lid members;

said other of said male and female catch member on said other of said first and second lid members; and said extending tab member being proximate said one of said male and female catch members, whereby during a use a flexing of said extending tab member disengages said male and female catch members and an urging return flex of said extending tab member re-engages said male and female catch members operative to engage said means for locking said first lid member to said second lid member in said continuous inter-lid seal.

11. A containment system, according to claim 10, further comprising:

hinge means pivotably operative between said bounded container and at least one of said lid members enabling said at least one of said lid members to transit through a motion arc from a fully sealed position to a fully open position; and said hinge means includes friction means for enabling said hinge means to support said at least one of said lid members at at least one user-selected position along said motion arc relative to said bounded container.

12. A containment system, according to claim 11, wherein:

said means for positive urging of said sealing lid system operative to enable one of a simultaneous closing of said first and said second lid members and a staged closing of said first and said second lid members, whereby said continuous inter-lid sealing is maintained.

13. A containment system, according to claim 10, further comprising:

an extending gasket member continuously extending from said sealing lid system;

a receiving region on said bounded container proximate said continuous rim; and said receiving region having a shape operative to receive a portion of said extending gasket member during a use thereof; whereby said operative and continuous sealing of said sealing lid system to said bounded container is maintained.

14. A containment system, according to claim 10, further comprising:

a dual sealing profile along said lid-sealing between said first lid member and said second lid member;

said dual sealing profile including a male projecting profile and a female receiving profile on respectively said first lid member and said second lid member.

15. A containment system, according to claim 14, wherein:

said dual sealing profile includes on said first lid member one of said male projecting profiles and one of said female receiving profiles and said second lid member containing respectively a first and a second female receiving profile;

whereby said lid-sealing between said first and second lid members includes an operative engagement of at least two interfitting sealing profiles.

16. A containment system, according to claim 14, wherein:

said dual sealing profile includes a gasket member on each of said first lid member and said second lid member;

whereby said lid-sealing between said first and second lid members includes an operative pressure engagement of said gaskets.

17. A containment system, comprising:

a bounded container having a continuous rim;

said bounded container having compactable side walls, thereby allowing a reduction in a volume of said bounded container during a compaction thereof;

a sealing lid system engaging said continuous rim; and an interfit profile mechanism for positive urging of said sealing lid system to said continuous rim, whereby said mechanism for positive urging enables an operative and continuous secure sealing of said sealing lid system to said bounded container;

at least one channel profile spanning at least a portion of said sealing lid system;

said channel profile including a recessed passage defined as recessed relative to an upper surface of said sealing lid system, whereby external materials received on said sealing lid system transit through said recessed passage away from said sealing lid system and said continuous rim of said containment system;

said means for positive urging of said sealing lid system to said continuous rim, further comprising:

first flex-rim locking means for locking said sealing lid system to said continuous rim of said bounded container;

said first flex-rim locking means including an extending flex-rim tab member extending from said sealing lid system proximate said continuous rim and formed from a resilient material;

one of a male and a female catch member on said one of said first flex-rim tab member and said continuous rim;

said other of said male and female catch member on said other of said flex-rim tab member and said continuous rim; and said flex-rim extending tab member being proximate said one of said male and female catch members, whereby during a use a flexing of said flex-rim extending tab member disengages said male and female catch members and an urging return flex of said flex-rim extending tab member re-engages said male and female catch members operative to engage said first flex-rim locking means for locking said sealing lid system to said continuous rim in said continuous seal.

18. A containment system, according to claim 17, further comprising:

an extending arm member projecting from said sealing lid system toward said continuous rim;

said extending gasket member proximate an end of said extending arm member; and said flexing arm member flexing during said use to disturb a resting position of said bushing into a sealing position in said receiving region and provide a continuous urging force during said use to maintain said operative and continuous sealing of said sealing lid system to said bounded container.

* * * * *